US012467439B1

(12) United States Patent
Dimitrijević

(10) Patent No.: US 12,467,439 B1
(45) Date of Patent: Nov. 11, 2025

(54) PISTON PUMP AND METHOD OF MANUFACTURING THE SAME

(71) Applicant: Nebojša Dimitrijević, Užice (RS)

(72) Inventor: Nebojša Dimitrijević, Užice (RS)

( * ) Notice: Subject to any disclaimer, the term of this patent is extended or adjusted under 35 U.S.C. 154(b) by 0 days.

(21) Appl. No.: 19/069,120

(22) Filed: Mar. 3, 2025

Related U.S. Application Data

(63) Continuation of application No. 18/658,876, filed on May 8, 2024, now Pat. No. 12,270,395.

(51) Int. Cl.

| | |
|---|---|
| ***F04B 9/04*** | (2006.01) |
| ***F04B 1/0404*** | (2020.01) |
| ***F04B 1/0408*** | (2020.01) |
| ***F04B 1/0531*** | (2020.01) |
| ***F04B 1/0538*** | (2020.01) |
| ***F04B 53/14*** | (2006.01) |

(52) U.S. Cl.
CPC ..... *F04B 9/042* (2013.01); *F04B 1/0404* (2013.01); *F04B 1/0408* (2013.01); *F04B 1/0531* (2013.01); *F04B 1/0538* (2013.01); *F04B 53/14* (2013.01)

(58) Field of Classification Search
CPC ..... F04B 9/042; F04B 1/0404; F04B 1/0408; F04B 1/0531; F04B 1/0538; F04B 53/14
See application file for complete search history.

(56) References Cited

U.S. PATENT DOCUMENTS 4,111,617 A * 9/1978 Gale ..... F01C 1/104 418/61.3
4,366,747 A 1/1983 Falendysz et al.
4,918,806 A * 4/1990 Watanabe ..... B23P 15/10 29/527.4
5,067,369 A 11/1991 Taniguchi
6,178,837 B1 * 1/2001 Nagai ..... F16D 59/02 74/89.23
6,237,441 B1 5/2001 Nishioka et al.
6,764,285 B1 * 7/2004 Kellner ..... F04B 1/0413 92/72
9,611,840 B2 * 4/2017 Celotta ..... F04B 9/045
(Continued)

FOREIGN PATENT DOCUMENTS

CN 102395788 B * 10/2014 ..... F02M 59/102
DE 4118003 A1 12/1991
(Continued)

*Primary Examiner* — Dominick L Plakkoottam
(74) *Attorney, Agent, or Firm* — Renner, Otto, Boisselle & Sklar, LLP

(57) ABSTRACT

A piston pump has a near-circular cam design for improved longevity and efficiency. The piston pump includes a rotatably mounted crankshaft, one or more near-circular cams, and one or more pistons. The near-circular cams include one or more cam noses and one or more cam heels. The cam noses are circumferentially alternating with the cam heels around the crankshaft axis. Each cam nose has a nose radius, each cam heel has a heel radius, and the nose radius is greater than the heel radius. Each near-circular cam has a cam stroke length that is a difference between the nose radius and the heel radius, and a cam convexity characteristic of greater than 1 and less than 1.35. Each piston is slidably mounted relative to the crankshaft between a nose position when in contact with a cam nose, and a heel position when in contact with a cam heel.

18 Claims, 21 Drawing Sheets

(56) References Cited

U.S. PATENT DOCUMENTS 9,638,074 B1 * 5/2017 Ploughe ..... F01L 1/047
9,709,013 B2 * 7/2017 Yudanov ..... F02M 59/44
9,709,152 B2 7/2017 Lechner et al.
10,371,145 B2 8/2019 Johnston et al.
2002/0040704 A1 * 4/2002 Onishi ..... F04B 1/0413 123/457
2003/0029424 A1 * 2/2003 Ryuzaki ..... F02M 59/08 123/456
2006/0177327 A1 * 8/2006 Kosek ..... B60T 8/4031 417/470
2008/0295807 A1 * 12/2008 Bauer ..... F04B 1/0531 123/495
2009/0090334 A1 * 4/2009 Hyde ..... F02B 75/048 310/20
2009/0164093 A1 * 6/2009 Sczomak ..... F02M 39/02 123/446
2009/0185923 A1 * 7/2009 Sato ..... F02M 59/464 417/545
2011/0171045 A1 * 7/2011 Gilpatrick ..... F04B 17/06 417/521
2012/0244018 A1 * 9/2012 Reilly ..... B01F 35/882 417/266
2014/0231579 A1 * 8/2014 Fenny ..... F15B 7/003 244/17.11
2015/0225805 A1 * 8/2015 Goodwin ..... H05B 6/362 219/635
2017/0276125 A1 * 9/2017 Ishikura ..... F04B 1/06
2020/0277922 A1 * 9/2020 Tamai ..... F02M 45/063
2021/0088043 A1 * 3/2021 Geissler ..... F04B 1/08
2021/0331376 A1 * 10/2021 Preston ..... B29C 64/118
2023/0213010 A1 * 7/2023 Inui ..... F04B 1/0413 123/508

FOREIGN PATENT DOCUMENTS

DE 102006027514 A1 * 12/2007 ..... B60T 8/4031
JP 2008038604 A * 2/2008

* cited by examiner

PRIOR ART

PISTON PUMP AND METHOD OF MANUFACTURING THE SAME

RELATED APPLICATIONS

This application is a continuation of and claims priority of U.S. application Ser. No. 18/658,876, filed May 8, 2024, which is hereby incorporated herein by reference in its entirety.

FIELD

This application relates to the field of piston pumps and methods of manufacturing piston pumps and parts thereof.

INTRODUCTION

Piston pumps are pumps that use reciprocating motion of pistons to move fluid through a system. Piston pumps are classified as positive displacement pumps, which move a volume of fluid for each cycle. In traditional piston pumps, the cycle for each piston includes a suction stroke, in which the piston is moved a distance to draw the volume of fluid into a chamber, and a discharge stroke, in which the piston is returned that distance to displace the volume of fluid from the chamber.

DRAWINGS

SUMMARY

Figure 1A:
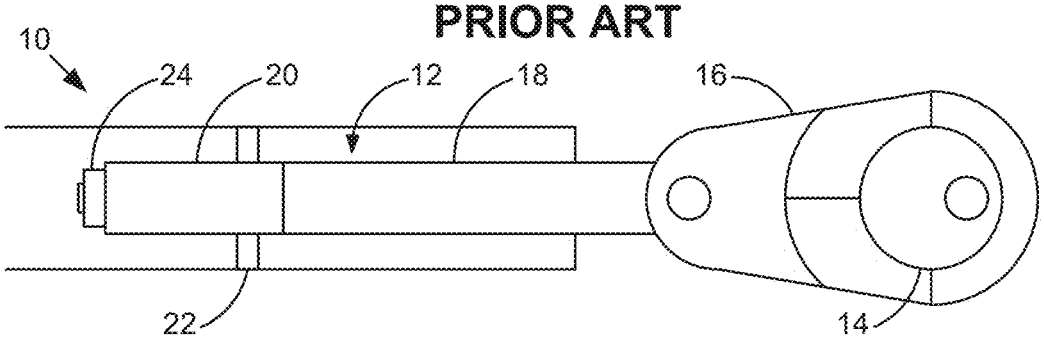
FIG. 1A is a schematic side view of an example piston assembly of an existing piston pump with a piston at the end of a discharge stroke and the start of a suction stroke.

In accordance with one aspect of this disclosure, a piston pump has a pump housing having a crankshaft chamber, a pumping chamber, and a plurality of piston passages, the piston passages extending from the crankshaft chamber to the pumping chamber. The piston pump further has a crankshaft rotatably mounted in the crankshaft chamber, the crankshaft having a longitudinally extending crankshaft rotation axis, and a plurality of cams distributed along the crankshaft axis. Each cam has a plurality of cam noses and a plurality of cam heels, the cam noses circumferentially alternating with the cam heels around the crankshaft axis, the cam noses all having a nose radius, the cam heels all having a heel radius, the nose radius being greater than the heel radius, a cam stroke length that is a difference between the nose radius and the heel radius, and a cam material abrasion resistance. The piston pump further has a plurality of pistons, each piston corresponding to a cam of the plurality of cams, each piston slidably mounted in a corresponding piston passage of the plurality of piston passages between a nose position and a heel position. Each piston has a piston shaft extending within the corresponding piston passage, the piston shaft having a first shaft end positioned in the crankshaft chamber and a second shaft end; and a sacrificial piston crown removably connected to the first shaft end, the piston crown having a cam engagement side in contact with the corresponding cam, the cam engagement side having a piston crown material abrasion resistance that is less than the cam material abrasion resistance. The piston pump further has a plurality of resiliently compressible piston biases, each piston bias biasing a corresponding piston of the plurality of pistons toward the crankshaft and maintaining constant contact between the cam engagement side of the piston crown and the corresponding cam of the piston as the crankshaft rotates, the piston being in the nose position when the cam engagement side is in contact with the nose of the cam, and the piston being in the heel position when the cam engagement side is in contact with the heel of the cam.

In accordance with one aspect of this disclosure, a piston pump has a pump housing having a crankshaft chamber, a pumping chamber, and a plurality of piston passages, the piston passages extending from the crankshaft chamber to the pumping chamber. The piston pump further has a crankshaft rotatably mounted in the crankshaft chamber, the crankshaft having a longitudinally extending crankshaft rotation axis, and a plurality of cams distributed along the crankshaft axis. The piston pump further has a plurality of pistons, each piston corresponding to a cam of the plurality of cams, each piston slidably mounted in a corresponding piston passage of the plurality of piston passages between a nose position and a heel position. Each piston has a piston shaft extending within the corresponding piston passage, the piston shaft having a first shaft end positioned in the crankshaft chamber and a second shaft end. The piston shaft has a unitary construction of solid metal and an exterior surface. At least a portion of the exterior surface has an abrasion-resistance surface treatment. Each piston further has a piston crown connected to the first shaft end, the piston crown having a cam engagement side in contact with the corresponding cam. The piston pump further has a plurality of resiliently compressible piston biases, each piston bias biasing a corresponding piston of the plurality of pistons toward the crankshaft and maintaining constant contact between the cam engagement side of the piston crown and the corresponding cam of the piston as the crankshaft rotates.

In accordance with one aspect of this disclosure, a piston pump has an extrusion-formed pump housing having a crankshaft chamber, a pumping chamber, and a plurality of piston passages, the piston passages extending from the crankshaft chamber to the pumping chamber. The piston pump further has an extrusion-formed crankshaft rotatably mounted in the crankshaft chamber, the crankshaft having a longitudinally extending crankshaft rotation axis, and a plurality of cams distributed along the crankshaft axis. The piston pump further has a plurality of pistons, each piston corresponding to a cam of the plurality of cams, each piston slidably mounted in a corresponding piston passage of the plurality of piston passages between a nose position and a heel position. Each piston has a piston shaft extending within the corresponding piston passage, the piston shaft having a first shaft end positioned in the crankshaft chamber and a second shaft end, and a piston crown connected to the first shaft end, the piston crown having a cam engagement side in contact with the corresponding cam. The piston pump further has a plurality of resiliently compressible piston biases, each piston bias biasing a corresponding piston of the plurality of pistons toward the crankshaft and maintaining constant contact between the cam engagement side of the piston and the corresponding cam of the piston as the crankshaft rotates.

In accordance with one aspect of this disclosure, a method of mass-producing crankshafts for a piston pump includes segmenting a crankshaft axle precursor formed as an elongated circular rod into a first crankshaft axle and a second crankshaft axle, each of the first and second crankshaft axles having an axle length; extruding a cam precursor as an elongated non-circular rod; segmenting the cam precursor into a first plurality of cams and a second plurality of cams, each of the cams in the first and second plurality of cams having a cam width; machining a central axle opening through each cam of the first and second plurality of cams, the central axle opening having an opening diameter sized to receive an outer diameter of the crankshaft axles; mounting the first plurality of cams onto the first crankshaft axle by inserting the first crankshaft axle into the central axle opening of the first plurality of cams, and mounting the second plurality of cams onto the second crankshaft axle by inserting the second crankshaft axle into the central axle opening of the second plurality of cams; and rigidly connecting the first plurality of cams to the first crankshaft axle along the axle length of the first crankshaft axle, and rigidly connecting the second plurality of cams to the second crankshaft axle along the axle length of the second crankshaft axle.

In accordance with one aspect of this disclosure, a method of mass-producing pistons for a piston pump includes segmenting a piston shaft precursor formed as an elongated rod into a first piston shaft and a second piston shaft, each of the first and second piston shafts having a shaft length extending from a first shaft end to a second shaft end; applying an abrasion-resistance treatment to a surface of the first piston shaft for at least a portion of the shaft length of the first piston shaft, and applying an abrasion-resistance treatment to a surface of the second piston shaft for at least a portion of the shaft length of the second piston shaft; extruding a piston crown precursor formed as an elongated profile having a cam engagement side and an opposed shaft engagement side; segmenting the piston crown precursor into a first piston crown and a second piston crown, each of the first and second piston crowns having the cam engagement side, the shaft engagement side, and a crown width; and connecting the shaft engagement side of the first piston crown to the first shaft end of the first piston shaft, and connecting the shaft engagement side of the second piston crown to the first shaft end of the second piston shaft.

In accordance with one aspect of this disclosure, a method of mass producing piston pumps includes the method of mass producing crankshafts in accordance with one aspect of this disclosure; the method of mass producing pistons in accordance with one aspect of this disclosure to produce a first plurality of pistons and a second plurality of pistons; extruding a pump main body precursor formed as an elongated profile having a top wall, a bottom wall, and a rear wall extending between the top and bottom walls; segmenting the pump main body precursor into a first pump main body and a second pump main body, each of the first and second pump main bodies having the top, bottom, and rear walls, a first side opening, and a second side opening, each of the first and second side openings defined between the top, bottom, and rear walls; and assembling a first piston pump by connecting the first crankshaft, the first plurality of pistons, the first pump main body, and a first pair of sidewalls, and assembling a second piston pump by connecting the second crankshaft, the second plurality of pistons, the second pump main body, and a second pair of sidewalls.

These and other aspects and features of various embodiments will be discussed in greater detail below.

DESCRIPTION OF VARIOUS EMBODIMENTS

Numerous embodiments are described in this application, and are presented for illustrative purposes only. The described embodiments are not intended to be limiting in any sense. The invention is widely applicable to numerous embodiments, as is readily apparent from the disclosure herein. Those skilled in the art will recognize that the present invention may be practiced with modification and alteration without departing from the teachings disclosed herein. Although particular features of the present invention may be described with reference to one or more particular embodiments or figures, it should be understood that such features are not limited to usage in the one or more particular embodiments or figures with reference to which they are described.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", "joined", "affixed", "secured", or "fastened" where the parts are joined or operate together either directly or indirectly (i.e., through one or more intermediate parts), so long as a link occurs. As used herein and in the claims, two or more parts are said to be "directly coupled", "directly connected", "directly attached", "directly joined", "directly affixed", or "directly fastened" where the parts are connected in physical contact with each other. As used herein, two or more parts are said to be "rigidly coupled", "rigidly connected", "rigidly attached", "rigidly joined", "rigidly affixed", or "rigidly fastened" where the parts are coupled so as to move as one while maintaining a constant orientation relative to each other. None of the terms "coupled", "connected", "attached", "joined", "affixed", and "fastened" distinguish the manner in which two or more parts are joined together.

Further, although method steps may be described (in the disclosure and/or in the claims) in a sequential order, such methods may be configured to work in alternate orders. In other words, any sequence or order of steps that may be described does not necessarily indicate a requirement that the steps be performed in that order. The steps of methods described herein may be performed in any order that is practical. Further, some steps may be performed simultaneously.

As used herein and in the claims, a group of elements are said to 'collectively' perform an act where that act is performed by any one of the elements in the group, or performed cooperatively by two or more (or all) elements in the group.

Some elements herein may be identified by a part number, which is composed of a base number followed by an alphabetical or subscript-numerical suffix (e.g. 112*a*, or $\mathbf{112}_1$). Multiple elements herein may be identified by part numbers that share a base number in common and that differ by their suffixes (e.g. $\mathbf{112}_1$, $\mathbf{112}_2$, and $\mathbf{112}_3$). All elements with a common base number may be referred to collectively or generically using the base number without a suffix (e.g. 112). For clarity of the drawings, only a first instance or only a few instances of all elements with a common base number may be labelled in the drawings.

The design of existing piston pumps, such as existing linear/reciprocating piston pumps, presents numerous problems in the manufacturability and longevity of the pump. For example, existing piston pumps implement various types of eccentric crankshafts, which are time-intensive, labor-intensive, and thus costly to manufacture. These crankshafts are often made by forging, which requires significant energy consumption. Further, due to their eccentric nature, these crankshafts are subsequently machined using slow, high-energy consumption turning mill methods to produce crankshafts balanced for optimal performance (i.e., to avoid vibration and the resultant failure of the various components of the piston pump). Similarly, other components of existing piston pumps (e.g., connecting rods, pump body) are often made by casting, which also requires significant time investment and energy consumption. The separately cast components may also require transport from the foundry at which they were cast to a common machining facility for subsequent machining.

FIGS. 1A to 1D show a typical piston assembly 10 of an existing piston pump. The piston assembly 10 includes a piston 12 connected to an eccentric crankshaft 14 by a connecting rod 16. As shown, the piston 12 is commonly a two-piece construction including a piston rod 18 and a plunger 20. In operation, for each revolution of the eccentric crankshaft 14, the piston 12 is moved by the crankshaft 14, via the connecting rod 16, between a suction stroke (see e.g., FIGS. 1A to 1B) and a discharge stroke (see e.g., FIGS. 1C to 1D). Producing a single suction stroke and discharge stroke for each revolution of the crankshaft 14 may result in a discontinuous or unsteady discharge of the pumping fluid. Additionally, due to wear of the connecting rod 16 through the normal course of operation, the displacement of the piston 12 in each stroke may decrease over time, resulting in a decrease in a pumping volume of the piston assembly 10 and thus further degrading pump performance.

During each stroke, the piston 12 slides through a fluid seal 22 in constant contact with the seal 22. Due to this contact, the plunger 20 is often made of a ceramic for the high abrasion resistance of ceramic, while a steel piston rod 18 is often used for steel's ability to withstand the forces of the pressurized fluid during the discharge stroke. However, this design requires a perfect seal between the piston rod 18 and the plunger 20 to prevent leaking. Consequently, high precision in manufacturing and assembly of the piston rod 18 and plunger 20 is required, increasing the associated time and cost of manufacture. Further, in the two-piece construction of the piston 12, the ceramic plunger 20 is connected to the piston rod 18 by a washer and nut 24, which hold the plunger 20 in compression between the piston rod 18 and the washer and nut 24. In production, if the nut 24 is tightened too much, the ceramic plunger 20 may crack, leading to leaking through the seal 22. Conversely, if the nut 24 is not tightened enough, fluid may pass between the plunger 20 and the piston rod 18 and thereby leak through the seal 22.

Figure 1B:
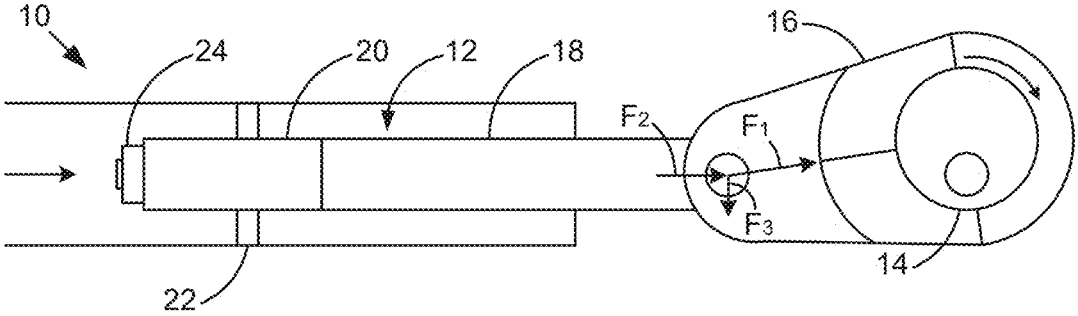
FIG. 1B is a schematic side view of the piston assembly of FIG. 1A during the suction stroke.
Figure 1C:
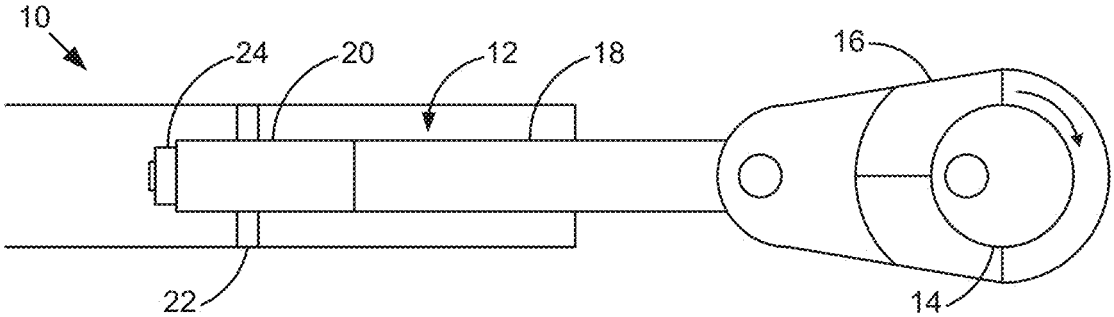
FIG. 1C is a schematic side view of the piston assembly of FIG. 1A at the end of the suction stroke and the start of the discharge stroke.
Figure 1D:
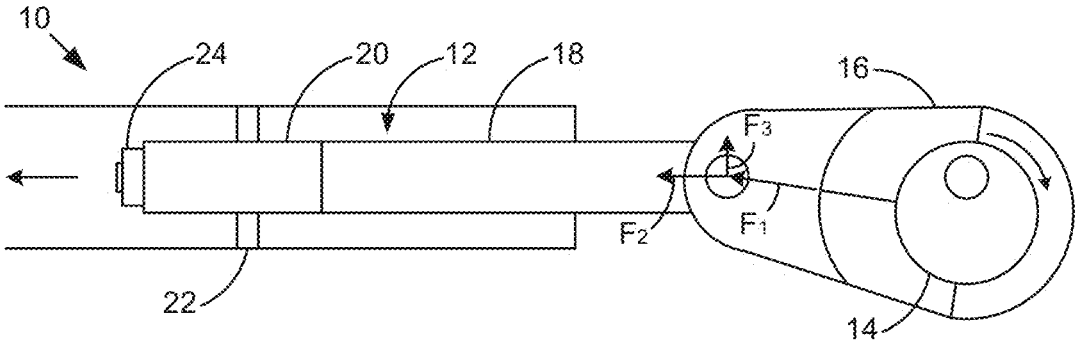
FIG. 1D is a schematic side view of the piston assembly of FIG. 1A during the discharge stroke.

Further, as shown in FIGS. 1B and 1D, due to the eccentric nature of the crankshaft 14, a total force $F_1$ of the connecting rod 16 on the piston 12 during the suction and discharge strokes includes a pull/push component $F_2$ along a longitudinal dimension of the piston 12 and a downward/upward component $F_3$ that is transverse to the longitudinal dimension of the piston 12. In standard piston assemblies, such as the piston assembly 10 shown, the downward/upward component $F_3$ may lead to increased force of contact between the seal 22 and the piston rod 18 and/or plunger 20 during the suction and discharge strokes. In particular, the downward component $F_3$ shown in FIG. 1D can reach 20% or more of the total force $F_1$ that is needed to push the piston 12 against the pressurized fluid during the discharge stroke. As a result of the increased force of contact caused by to the downward/upward component $F_3$, the piston rod 18, plunger 20, and/or seal 22 may wear at an accelerated rate, leading to premature failure of one or more of these components and leakage of fluid through the seal 22. Such increased force of contact may also lead to increased vibration during operation of the piston pump and thereby premature failure of the pump body or the components therein.

Figure 2:
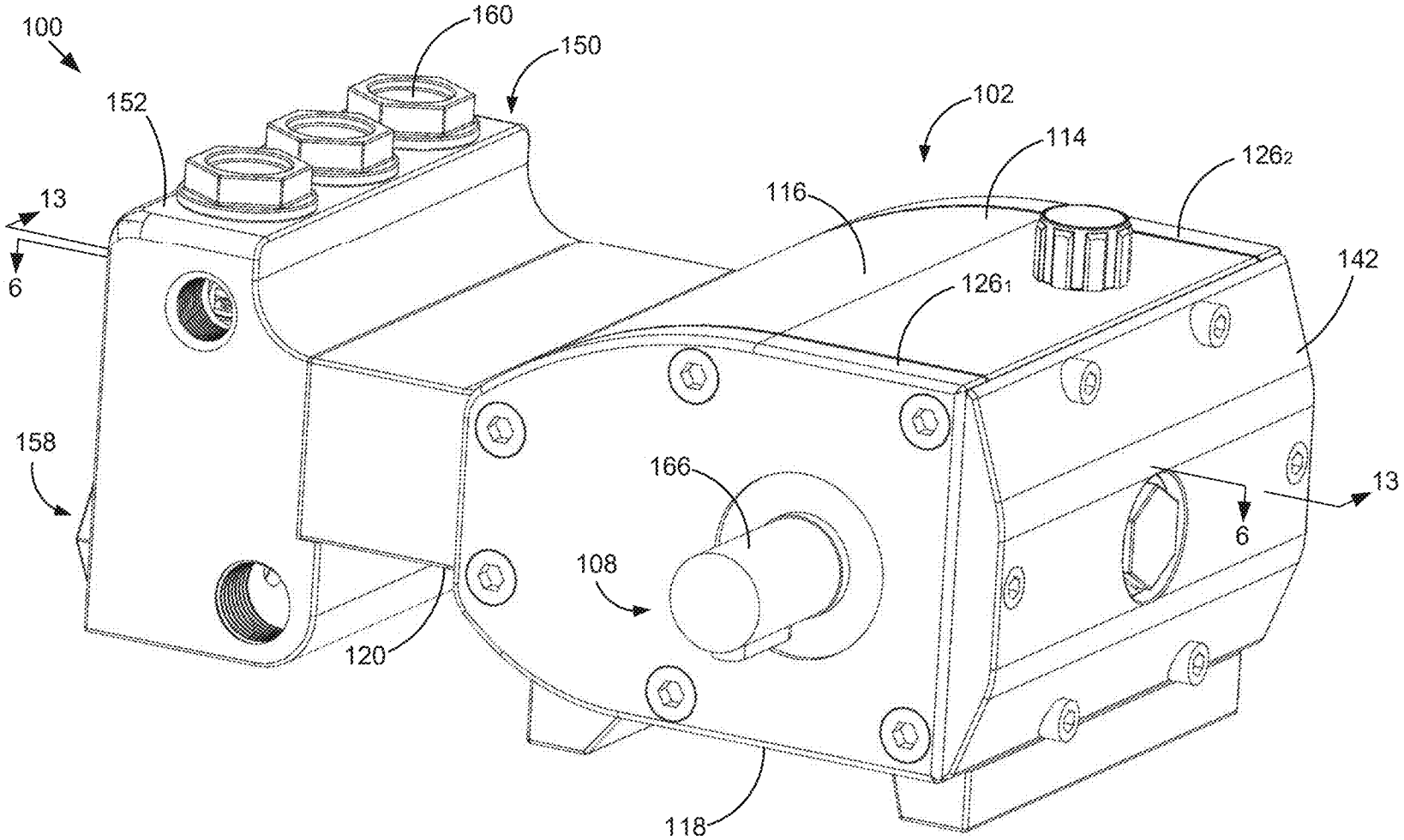
FIG. 2 is a perspective view of an example piston pump, in accordance with an embodiment.
Figure 3:
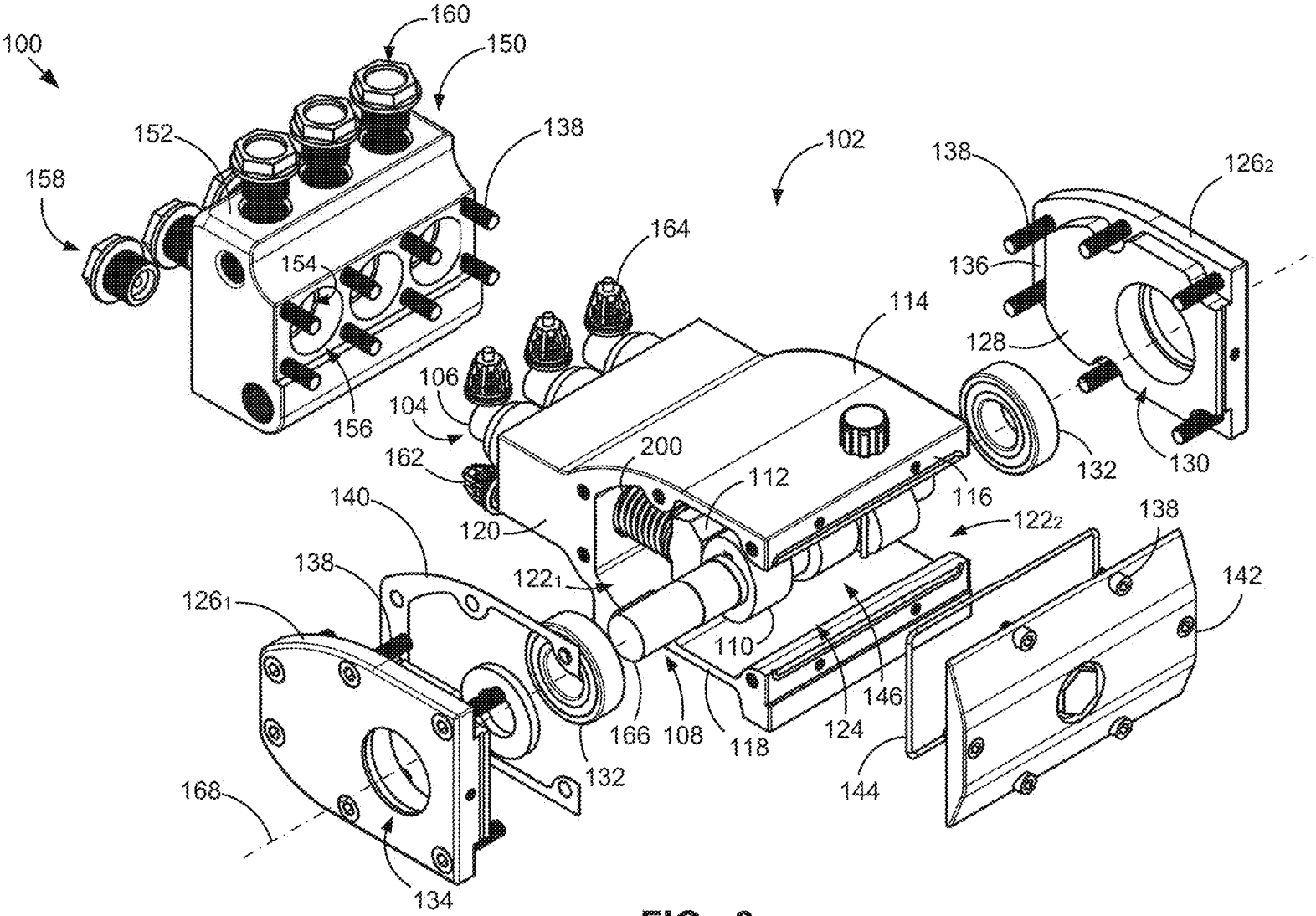
FIG. 3 is an exploded view of the piston pump of FIG. 2.
Figure 4:
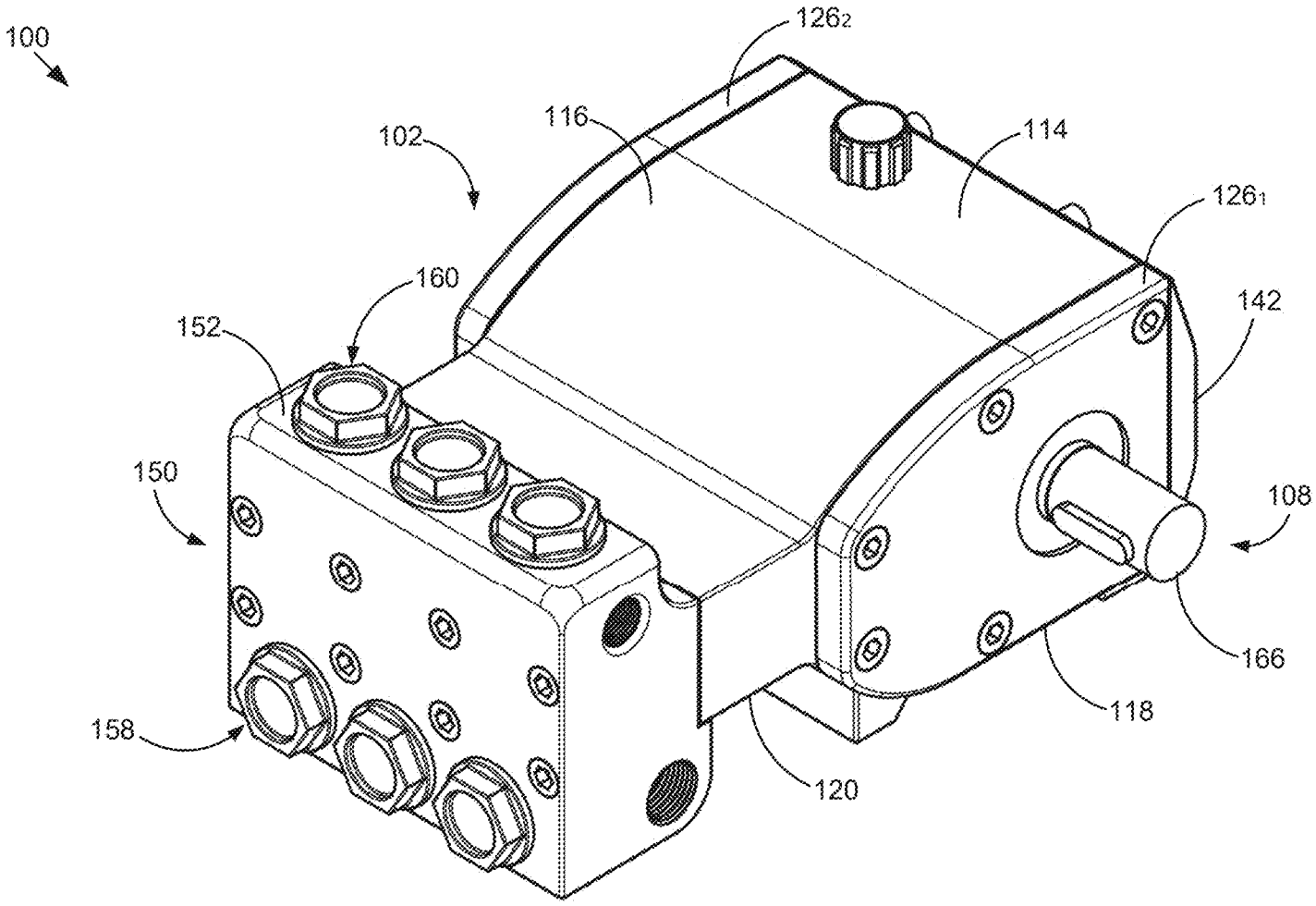
FIG. 4 is another perspective view of the piston pump of FIG. 2.
Figure 5:
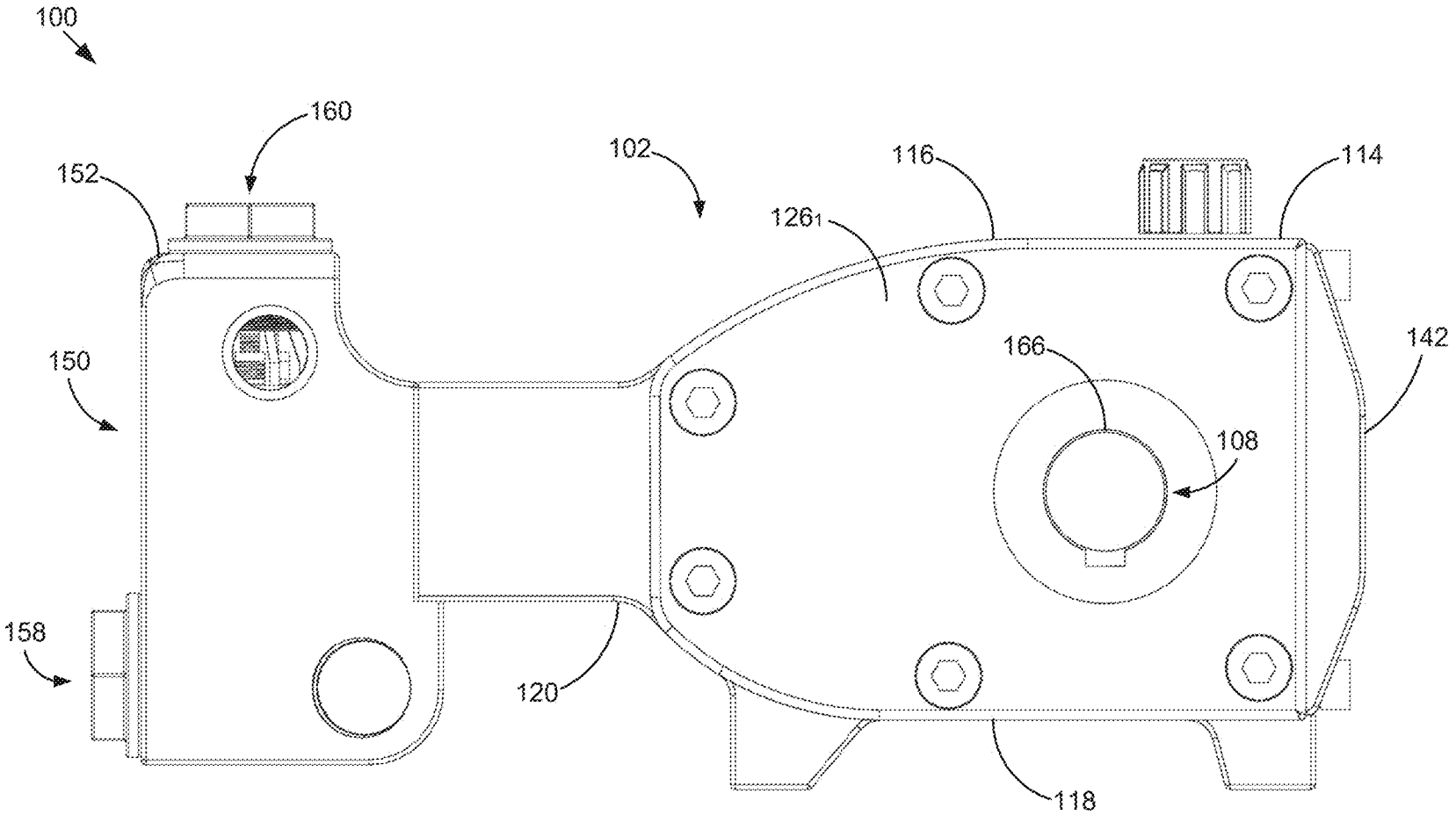
FIG. 5 is a side view of the piston pump of FIG. 2.

Referring to FIGS. 2 and 3, disclosed herein is a piston pump, generally referred to as piston pump 100, which addresses one or more (or all) of the above-described issues in existing piston pumps. For clarity, embodiments of piston pump 100 may address any one or more of the above-described problems, and as such, some embodiments may yet have one or more of the above-described problems unresolved. In some cases, embodiments of piston pump 100 may address other problems or have other advantages not described above and have all the above-described problems may remain unresolved. In the illustrated example, the piston pump 100 includes a pump housing 102 containing a plurality of pistons 104 having a piston shaft 106 (better seen e.g., in FIG. 14A) and a crankshaft 108 having a plurality of non-circular cams 110. As shown, each piston 104 has a piston crown 112 resiliently biased to engage a corresponding cam 110 such that, in operation, the pistons 104 may be displaced by rotation of the crankshaft 108 as the portion of the non-circular cam 110 with which the piston crown 112 is engaged changes. It will be appreciated that, while the drawings show only three pistons 104 and three cams 110, any number of pistons 104 and cams 110 may be used in accordance with this disclosure, which may depend on the size of the piston pump 100 and/or the desired pumping volume thereof.

The design of the piston pump 100 may mitigate or eliminate any one or more (or all) of the issues common to existing piston pumps described previously, including while pumping fluid at high pressures. For example, the use of non-circular cams 110 (e.g., ellipsoid, triangular, square, etc.) increases the number of strokes of the pistons 104 per revolution of the crankshaft 108 (e.g., 4 strokes, 6 strokes, 8 strokes, etc.), which may provide a steadier discharge of the pumping fluid and/or a greater pumping volume. Additionally, the cams 110 may have a greater abrasion resistance than the piston crowns 112, which may result in the piston crowns 112 eroding over time. This may prevent or minimize erosion of the cams 110, which may thereby preserve stroke length of the pistons 104 and thus preserve pumping volume of the piston pump 100 through time.

As another example, the piston shafts 106 of the pistons 104 may optionally have a unitary design that eliminates the failure modes associated with a typical two-piece piston common in existing piston pumps. Instead of relying on the abrasion resistance of ceramic, the piston shafts 106 may have an abrasion-resistance surface treatment providing sufficient abrasion resistance for sliding contact with a fluid seal. Additionally, the total force of the cams 110 on the pistons 104 during the suction and discharge strokes may remain substantially axially aligned with the piston shaft 106 as the piston shaft reciprocates between suction and discharge strokes. The downward/upward force component that is transverse to the longitudinal dimension of the pistons 104 may accordingly be reduced or eliminated. In particular, the downward/upward force component may be less than 10%, or more particularly less than 5%, of the total force needed to push the piston 104 against the pressurized fluid during the discharge stroke. Accordingly, the force of contact between a seal and the piston shaft 106 during the intake and discharge strokes may be less than that of existing piston pumps, which may decrease vibration of the piston pump 100, decrease the rate of wear of the piston shafts 106, and/or decrease the rate of wear of the seals, and thereby extend the service life of piston pump 100 and these components thereof.

Further, the design of the piston pump 100, as expanded upon subsequently herein, may be conducive to expeditious mass-production of such piston pumps. For example, any of the pump housing 102, the cams 110, the piston crowns 112, or any other component of the piston pump 100 may be manufactured by extrusion, providing fast, repeatable means of mass-producing such piston pumps with a high degree of control of material properties. The time and energy required to produce the piston pump 100 may accordingly be less than that required to produce existing piston pumps, and the time and energy may be further reduced per piston pump 100 when mass-produced as described herein.

Referring to FIGS. 2 to 6, in the illustrated example, the piston pump 100 shown is a linear piston pump. However, it will be appreciated that the principles of this disclosure may be applied to other reciprocating pumps such as radial pumps and diaphragm pumps, for example.

The pump housing 102 includes a pump main body 114. As shown, the pump main body 114 has a top wall 116, a bottom wall 118 opposite the top wall 116, and a rear wall 120 extending from and connecting the top wall 116 to the bottom wall 118. The pump main body 114 has a first side opening $\mathbf{122}_1$ and a laterally opposed second side opening $\mathbf{122}_2$. The first and second side openings 122 shown are defined between the top wall 116, bottom wall 118, and rear wall 120. The pump main body 114 may further have a front opening 124 opposite the rear wall 120 and defined between the top wall 116 and bottom wall 118.

The pump main body 114 may be made of any suitable metal or metal alloy, including one or more of iron, steel, stainless steel, titanium, and aluminum. In the illustrated example, the pump main body 114 is made of aluminum. In some embodiments, the profile of the pump main body 114 may be manufactured by extrusion, which may advantageously reduce costs of manufacturing, reduce the ecological impact of manufacturing, accelerate both individual production and mass-production of piston pumps, enable the use of many different alloys and fine control of the material properties thereof (e.g., material strength, which may be chosen depending on forces to be experienced by the piston pump and its components during operation, hereinafter the "operational forces") and, in the case of aluminum and aluminum alloys, enable aluminum anodizing for a range of colors of the pump housing 102. In other embodiments, none of pump main body 114 is manufactured by extrusion.

Referring to FIG. 3, the pump housing 102 further includes a first sidewall $\mathbf{126}_1$ and a second sidewall $\mathbf{126}_2$. As shown, the first and second sidewalls 126 include a central protruding portion 128. The central protruding portion 128 of the first and second sidewalls 126 may be shaped to slidably fit in the first and second side openings 122 between the top wall 116, bottom wall 118, and rear wall 120. An advantage of this design is that the central protruding portion 128 may strengthen the pump main body 114 by providing support between the cantilevered top and bottom walls 116, 118. Another advantage is that the central protruding portion 128 may improve the transfer of operational forces between the first and second sidewalls 126 and the pump main body 114, reducing stress concentration on any one part of the pump housing 102. In other embodiments, one or both of sidewalls 126 does not have a protruding portion 128.

The first and second sidewalls 126 may further include a bearing recess 130 shaped for receiving a bearing 132. The bearings 132 may be any size and type suitable for rotatably supporting the crankshaft 108 between the first and second sidewalls 126. As shown, the bearing recess 130 may be positioned such that, when the central protruding portions 128 of the first and second sidewalls 126 are inserted into the first and second side openings 122, the bearings 132 in the bearing recesses 130 are aligned. In this way, the crankshaft 108 may extend generally perpendicular to both the first sidewall $\mathbf{126}_1$ and the second sidewall $\mathbf{126}_2$ when rotatably mounted therebetween.

One of the first and second sidewalls 126, shown as the first sidewall $\mathbf{126}_1$ in the illustrated example, may include a crankshaft passage 134 positioned centrally within the bearing recesses 130 and extending through the sidewall from the bearing recesses 130. As shown, the crankshaft passage 134 permits the crankshaft 108 to extend through the first sidewall $\mathbf{126}_1$ such that rotation of the crankshaft 108 driven external to the pump housing 102 can drive rotation of the crankshaft 108 rotatably supported internal to the pump housing 102.

The first and second sidewalls 126 may further include a flange 136 bordering the central protruding portion 128 such that, when the central protruding portion 128 is inserted into the side opening 122, the flange 136 abuts the top wall 116, bottom wall 118, and rear wall 120. As shown, the flange 136 of the first and second sidewalls 126 is flush with (i.e., does not extend beyond) an outer surface of the pump main body 114. In alternate embodiments, the flange 136 of the first and second sidewalls 126 may extend beyond the outer surface of the pump main body 114. For example, the flange 136 may extend downwardly from the bottom wall 118 such that the first and second sidewalls 126 may also function as legs for the piston pump 100.

The first and second sidewalls 126 may be connected to the pump main body 114 by any suitable means. For example, the first and second sidewalls 126 may be permanently connected to the pump main body 114, such as by welding the flanges 136 to the top wall 116, bottom wall 118, and rear wall 120. Alternately, the first and second sidewalls 126 may be removably connected to the pump main body 114 using any suitable fastener to connect the flanges 136 to the top wall 116, bottom wall 118, and rear wall 120. For example, in the illustrated example, the first and second sidewalls 126 are removably connected to the pump main body 114 by a plurality of bolts 138 extending through the flanges 136 and into the top wall 116, bottom wall 118, and rear wall 120. An advantage of removably connecting one or both of the first and second sidewalls 126 to the pump main body 114 is that the sidewall(s) may be removed for inspection, maintenance, and/or replacement of the sidewall(s) or any other component of the piston pump 100 within the pump housing 102. In other embodiments, one or both of sidewalls 126 may be integrally formed with or permanently joined to pump main body 114 (e.g., by welds or rivets).

Optionally, sidewall seals 140 may be positioned between flanges 136 and the pump main body 114 before connecting the first and second sidewalls 126 to the pump main body 114. The sidewall seals 140 may be, for example, any suitable resiliently compressible material (e.g., rubber) that may be compressed between the flanges 136 and the pump main body 114 without splitting/breaking to provide a fluid-tight connection between the sidewalls 126 and the pump main body 114.

The first and second sidewalls 126 may be made of any suitable metal or metal alloy, including one or more of iron, steel, stainless steel, titanium, and aluminum. In the illustrated example, the first and second sidewalls 126 are made of steel. The first and second sidewalls 126 may receive and distribute the operational forces from the crankshaft 108. Accordingly, steel may be a desirable material for the sidewalls 126, such as in high-pressure piston pumps, due to its high strength. In other embodiments, one or both sidewalls 126 may be any other material of suitable strength for handling the operational forces.

While the first and second sidewalls 126 may be manufactured by any suitable method such as forging or casting, the first and second sidewalls 126 may be advantageously be manufactured by extrusion. Manufacturing by extrusion may confer similar benefits to those described above with respect to extrusion of the pump main housing 102. Additionally, manufacturing by extrusion may advantageously enable the production of sidewalls of more uniform thickness and uniform material properties, which may be selected according to the design parameters of the piston pump 100 (e.g., size, operational forces, etc.). In other embodiments, one or both of sidewalls 126 may be manufactured by means other than extrusion.

Referring still to FIG. 3, the pump housing 102 may further include a front wall 142 for closing the front opening 124 of the pump main body 114. As shown, when the front wall 142 is positioned over the front opening 124, the front wall 124 may abut the top wall 116, bottom wall 118, and first and second sidewalls 126. The front wall 142 may be permanently or removably connected to the pump main body 114 using any suitable means, such as those described with respect to the first and second sidewalls 126. In the illustrated example, the front wall 142 is removably connected to the pump main body 114 by a plurality of bolts 138 extending through the front wall 142 and into the top wall 116, bottom wall 118, and first and second sidewalls 126. In other embodiments, the front wall 142 may be permanently connected to, or integrally formed, the pump main body 114.

Optionally, the front wall 142 may include a central protruding portion similar to that of the first and second sidewalls 126 and shaped to slidably fit in the front opening 124 between the top wall 116, bottom wall 118, and the central protruding portions 128 of the first and second sidewalls 126. A central protruding portion of the front wall 142 may confer similar advantages to those described previously with respect to the central protruding portion 128 of the first and second sidewalls 126.

Optionally, a front wall seal 144 may be positioned between the front wall 142 and the pump main body 114 before connecting the front wall 142 to the pump main body 114. The front wall seal 144 may be, for example, any suitable resiliently compressible material (e.g., rubber) that may be compressed between the front wall 142 and the pump main body 114 without splitting/breaking to provide a fluid-tight connection between the front wall 142 and the pump main body 114.

The front wall 142 may be made of any suitable metal or metal alloy, including one or more of iron, steel, stainless steel, titanium, and aluminum. In the illustrated example, the front wall 142 is made of aluminum. While the front wall 142 may be manufactured by any suitable method such as forging or casting, the front wall 142 may be advantageously manufactured by extrusion, which may confer similar benefits to those described above with respect to extrusion of the pump main housing 102. Optionally, where the pump main body 114 and the front wall 142 are the same material, the pump main body 114 may be extruded with the front wall 142 such that the pump main body 114 is integrally formed therewith. In such examples, the central protruding portion 128 of the first and second sidewalls 126 may be shaped to slidably fit in the first and second opening 122 defined between the top wall 116, bottom wall 118, rear wall 120, and front wall 142, and the flange 136 of the first and second sidewalls 126 may be connected to the top wall 116, bottom wall 118, rear wall 120, and front wall 124 as described previously. In other embodiments, the front wall 142 may be manufactured by means other than extrusion.

Figure 6:
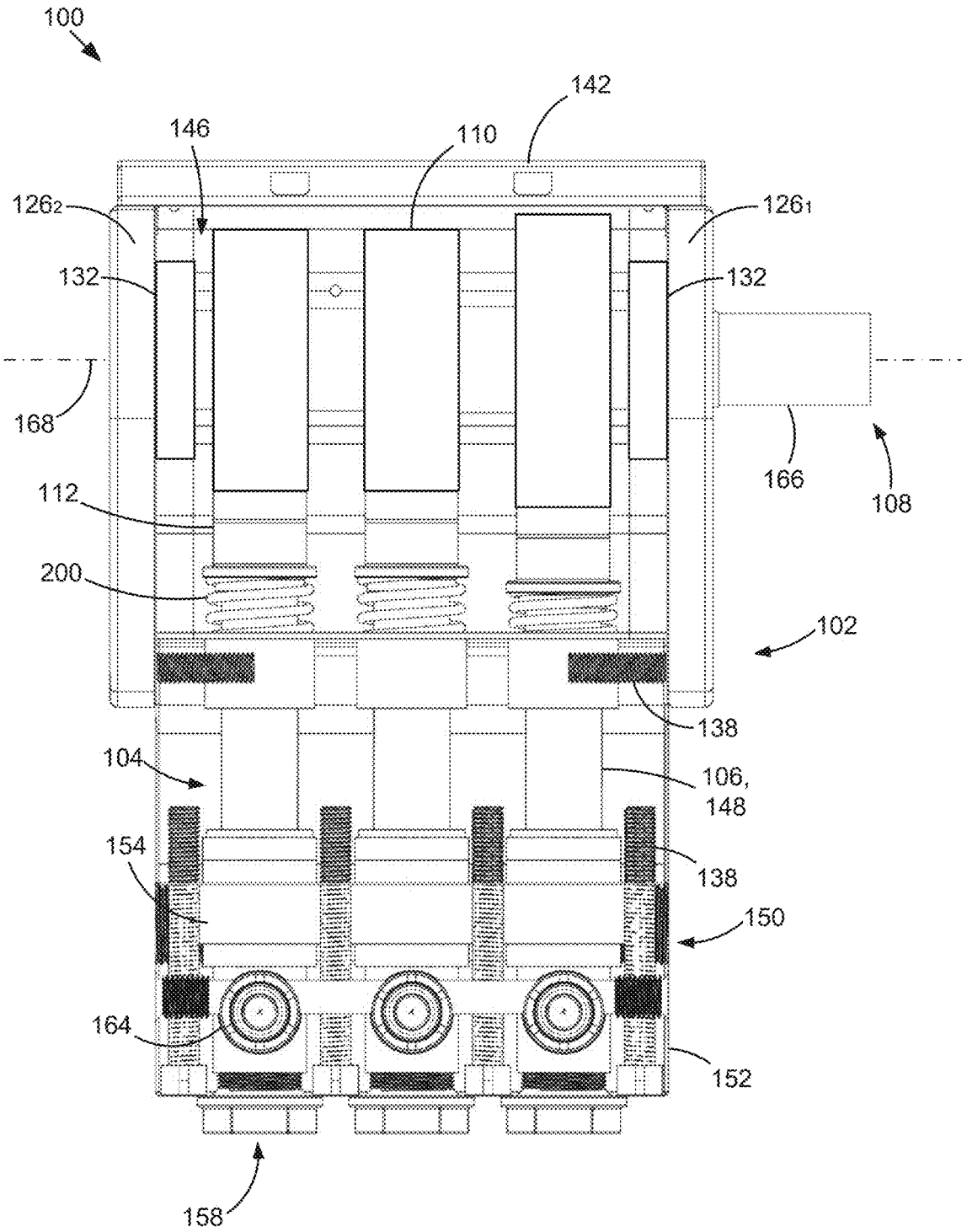
FIG. 6 is a top partial cross-sectional view of the piston pump of FIG. 2 taken along line 6-6 in FIG. 2.

Referring to FIGS. 3 and 6, when the first and second sidewalls 126 and the front wall 142 are connected to the pump main body 114, the pump housing 102 may include a crankshaft chamber 146 defined between the top wall 116, bottom wall 118, rear wall 120, first and second sidewalls 126, and front wall 142. As shown, the crankshaft 108 may be rotatably mounted within the crankshaft chamber 146 via bearings 132 as described previously. Any other means suitable for rotatably mounting the crankshaft 108 within the crankshaft chamber 146 may be used.

Figure 13A:
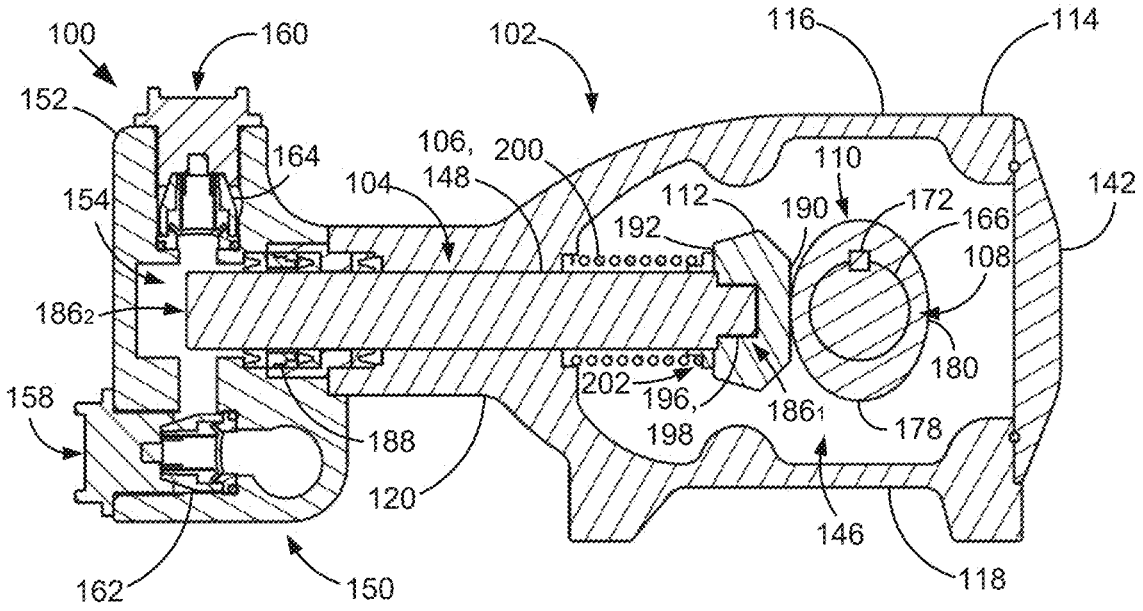
FIG. 13A is a side cross-sectional taken along line 13-13 in FIG. 2 with a piston in a heel position with an ellipsoid cam.

Referring still to FIGS. 3 and 6 and additionally to FIG. 13A, the pump housing 102 may further include a plurality of piston passages 148. As shown, the pistons passages 148 may extend through the rear wall 120 of the pump main body 114. Each of the piston passages 148 may have one of the pistons 104 slidably mounted therein. In manufacturing the piston pump 100, the piston passages 148 may be machined (e.g., drilled) through the rear wall 120 subsequent to the forming of the pump main housing 114, whether by forging, casting, or extrusion. In other embodiments, the piston passages 148 may be formed at the same time as the forming of the pump main housing 114.

The pump housing 102 may further have a pumping chamber 150 defined within a pumping chamber housing 152. As shown, the pumping chamber housing 152 may be connected to the rear wall 120 of the pump main body 114. In this way, the pumping chamber 150 may be spaced apart from the crankshaft chamber 146 by the rear wall 120. Consequently, the piston passages 148 may extend from the crankshaft chamber 146 to the pumping chamber 150. The pumping chamber housing 152 may be connected to the pump main body 114 by any suitable means. For example, pumping chamber housing 152 may be permanently connected to the pump main body 114, such as by welding to the rear wall 120. Alternately, pumping chamber housing 152 may be removably connected to the pump main body 114 using any suitable fastener. For example, as shown in the illustrated example, the pumping chamber housing 152 may be removably connected to the pump main body 114 by a plurality of bolts 138 extending into the rear wall 120. An advantage of removably connecting pumping chamber housing 152 to the pump main body 114 is that pumping chamber housing 152 may be removed for inspection, maintenance, and/or replacement of the components within the pumping chamber 150. In alternate embodiments, the pumping chamber housing 152 may be permanently connected to, or integrally formed with, the pump housing 102.

The pumping chamber 150 may be subdivided into a plurality of working chambers 154. Each working chamber 154 may include a piston opening 156 which, when the pumping chamber housing 152 is connected to the pump main body 114, may align with a corresponding one of the piston passages 148. In this way, each piston 104 may extend into one of the working chambers 154 from the piston passage 148 with which that working chamber 154 is aligned and in which the piston 104 is slidably mounted. In other embodiments, such as where the pumping chamber housing 152 is integrally formed with the pump housing 102, the working chambers 154 and the piston passage 148 may similarly be integrally formed.

As shown in the illustrated example, each working chamber 154 may further include a fluid intake port 158, through which fluid may be drawn into the working chamber 154, and a fluid outlet port 160, through which fluid may be discharged from the working chamber 154. The intake port 158 may include a non-return intake valve 162 (e.g., a check valve) and the outlet port 160 includes a non-return outlet valve 164 (e.g., a check valve). In operation, during the suction stroke wherein the piston 104 is withdrawn from the working chamber 154, the non-return intake valve 162 of the intake port 158 may be open and the non-return outlet valve 164 of the outlet port 160 may be closed. In this way, fluid may be drawn into the working chamber 154 during the suction stroke. Conversely, during the discharge stroke wherein the piston 104 is driven into the working chamber 154, the non-return intake valve 162 of the intake port 158 may be closed and the non-return outlet valve 164 of the outlet port 160 may be open. In this way, fluid may be expelled from the working chamber 154 during the discharge stroke.

Referring still to FIGS. 3 and 6, in the illustrated example, the crankshaft 108 of the piston pump 100 includes a crankshaft axle 166 rotatably mounted within the crankshaft chamber 146 about a longitudinally extending crankshaft rotation axis 168. As shown, the crankshaft axle 166 may be rotatably mounted via the bearings 132. The bearings 132 may be positioned as described previously such that the crankshaft axis 168 extends generally perpendicularly to the first and second sidewalls 126. Consequently, crankshaft axis 168 may extend generally parallel to the rear wall 120. In this way, the crankshaft axle 166 may have a constant spacing from the rear wall 120 across the crankshaft chamber 146. Similarly, the non-circular cams 110 of the crankshaft 108 may be connected to the crankshaft axle 166 and distributed along the crankshaft axis 168 such that, when the crankshaft axle 166 is mounted in the crankshaft chamber 146, each cam 110 is aligned with one of the piston passages 148 and the cams 110 may be equidistant from their respective piston passages 148 (i.e., when the cams 110 have the same orientation). An advantage of this design is that the operational forces on the crankshaft 108 (e.g., from resilient biases, pressurized pumping fluid) may be more evenly distributed across the crankshaft axle 166 and more evenly transferred to the first and second sidewalls 126. This may avoid uneven stress concentrations (e.g., in the crankshaft axle 166, bearings 132, sidewalls 126) that may otherwise lead to premature failure of the components of the piston pump 100. In other embodiments, the crankshaft axle 166 may be rotatably mounted within the crankshaft chamber 146 such that the crankshaft axis 168 extends at an angle to the first and second sidewalls 126 and/or to the rear wall 120.

The crankshaft axle 166 may be made of any suitable metal or metal alloy, including one or more of iron, steel, stainless steel, titanium, and aluminum. In the illustrated example, the crankshaft axle 166 is made of steel, which may be advantageous for transferring operational forces from the pistons 104 to the first and second sidewalls 126 due to the high strength of steel. In other embodiments, the crankshaft axle 166 may be any other material having any suitable diameter for providing the requisite strength for transferring operational forces. The crankshaft axle 166 may be manufactured by any suitable method such as forging, casting, or extrusion, or may be machined from a round stock rod of suitable diameter.

Referring to FIGS. 7 to 9, shown therein are various examples of non-circular cams 110 of the crankshaft 108. As shown, each cam 110 may have a central opening 170 sized to receive the crankshaft axle 166 such that each cam 110 is slidably removably connectable to the crankshaft axle 166 through the central opening 170. After slidably connecting to the crankshaft axle 166, the cams 110 can be rigidly connected to the crankshaft axle 166 by any suitable means, such as by one or more fasteners (e.g., screw, bolt), or welding. Connecting (e.g., rigidly) the cams 110 to the crankshaft axle 166 may inhibit the cams 110 from rotating relative to the crankshaft axle 166 about the crankshaft axis 168. Connecting the cams 110 to the crankshaft axle 166 may further inhibit the cams 110 from sliding on the crankshaft axle 166 along the crankshaft axis 168. In other embodiments, the cams 110 may be connected to the crankshaft axle 166 by different means. For example, the cams 110 may be integrally formed with the crankshaft axle 166 (e.g., machined in) or the cams 110 may each be a two-piece construction that may be connected around the crankshaft axle 166 at the desired position.

Figure 10A:
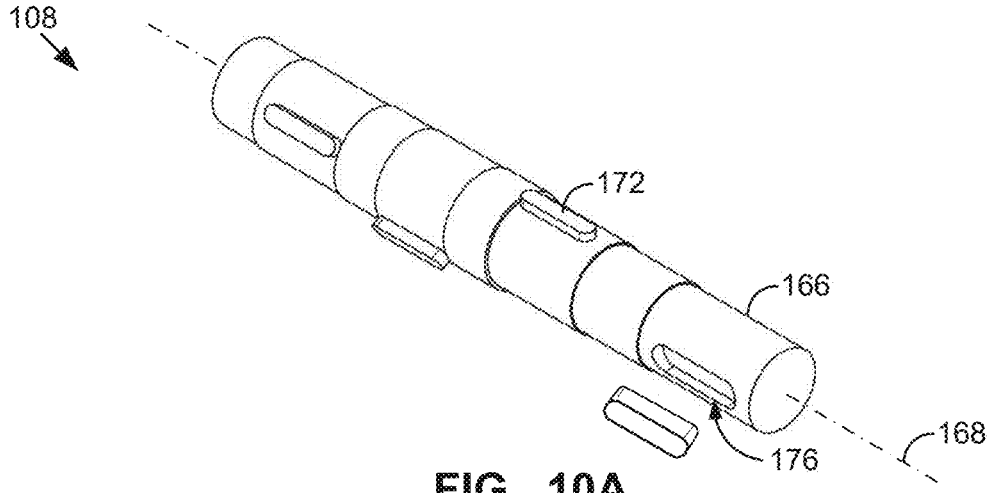
FIG. 10A is a perspective view of a crankshaft axle of a crankshaft usable with the piston pump of FIG. 2.
Figure 10B:
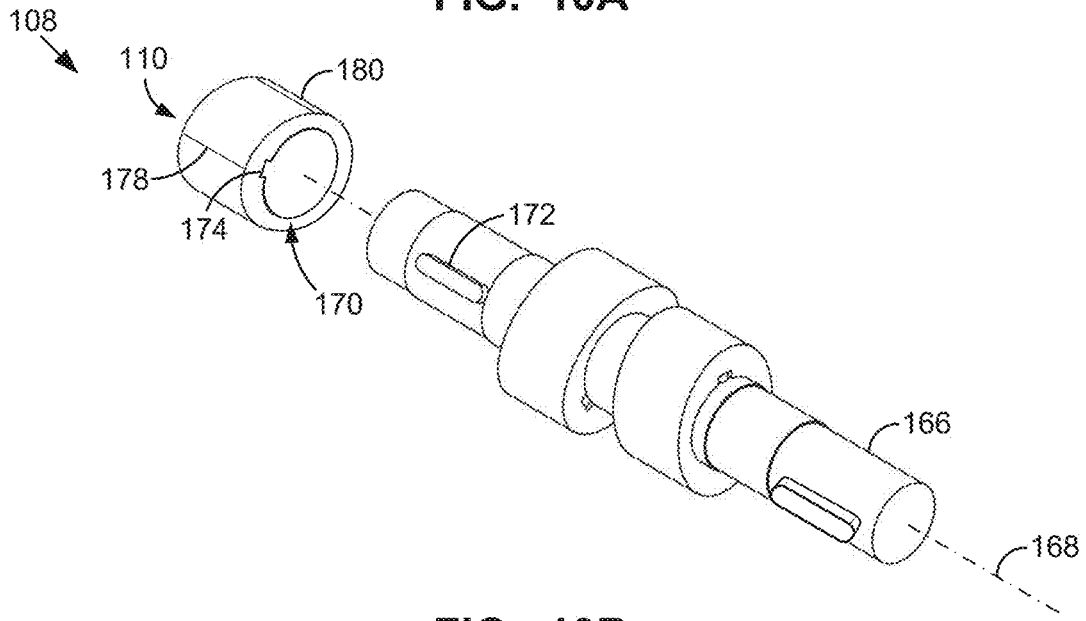
FIG. 10B is a perspective view of the crankshaft having a plurality of cams being mounted to the crankshaft axle.
Figure 10C:
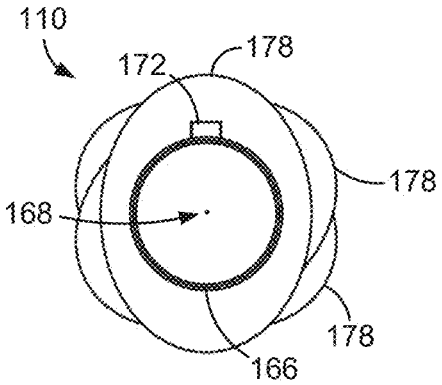
FIG. 10C is a front view of the crankshaft having the plurality cams mounted to the crankshaft axle at different angular orientations.

Additionally, or in the alternative, as exemplified in to FIGS. 10A to 10C, the crankshaft 108 may optionally include a plurality of cam securement pins 172 distributed along the crankshaft axis 168 and extending radially outwardly from the crankshaft axle 166, and the central opening 170 of the cams 110 may include a cam lock recess 174 shaped to slidably mate with one of the cam securement pins 172. In this way, when each cam 110 is slidably connected to the crankshaft axle 166, the cam lock recess 174 may slidably mate with one of the cam securement pins 172. The cam securement pins 172 may thus rigidly connect the mating cams 110 to the crankshaft axle 166 such that the cams 110 may be inhibited from rotating relative to the crankshaft axle 166 about the crankshaft axis 168. An advantage of the cam securement pins 172 and cam lock recesses 174 is that the cams 110 may be removably rigidly connected to the crankshaft axle 166 such that the cams 110 may be removed for replacement (e.g., at the end of service life of the cam). Another advantage is that differently shaped cams 110 may be used interchangeably in the same piston pump 100 (e.g., to change pump operation, such as pumping volume). In other embodiments, crankshaft 108 does not include cam securement pins.

The cam securement pins 172 may be connected to the crankshaft axle 166 by any suitable means (e.g., welding). In the example shown in FIGS. 10A and 10B, the crankshaft axle 166 includes a plurality of securement pin recesses 176 distributed along the crankshaft axis 168 and extending radially inwardly into the crankshaft axle 166. The cam securement pins 172 may be connected to the crankshaft axle 166 by insertion into the securement pin recesses 176 and held in a friction fit within the securement pin recesses 176 or, optionally, secured in the securement pin recesses 176 such as by adhesive, welding, or fasteners. In other embodiments, crankshaft axle 166 does not include securement pin recesses.

Figure 11A:
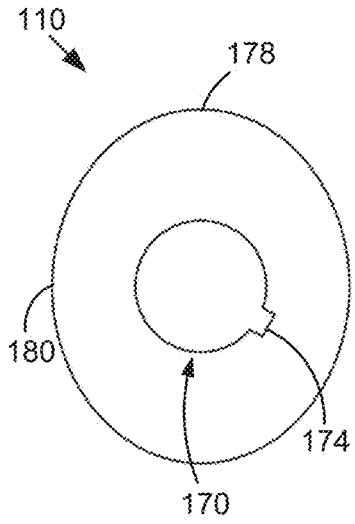
FIG. 11A is a front view of an example cam usable with the piston pump of FIG. 2 having a cam lock recess at a first angular orientation.
Figure 11B:
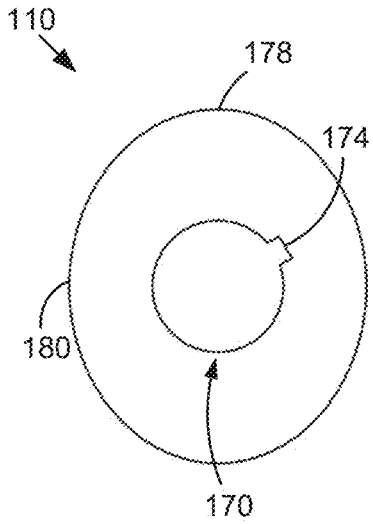
FIG. 11B is a front view of another example cam usable with the piston pump of FIG. 2 having a cam lock recess at a second angular orientation.
Figure 11C:
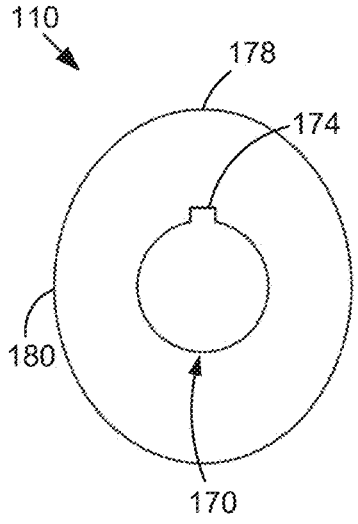
FIG. 11C is a front view of another example cam usable with the piston pump of FIG. 2 having a cam lock recess at a third angular orientation.
Figure 12:
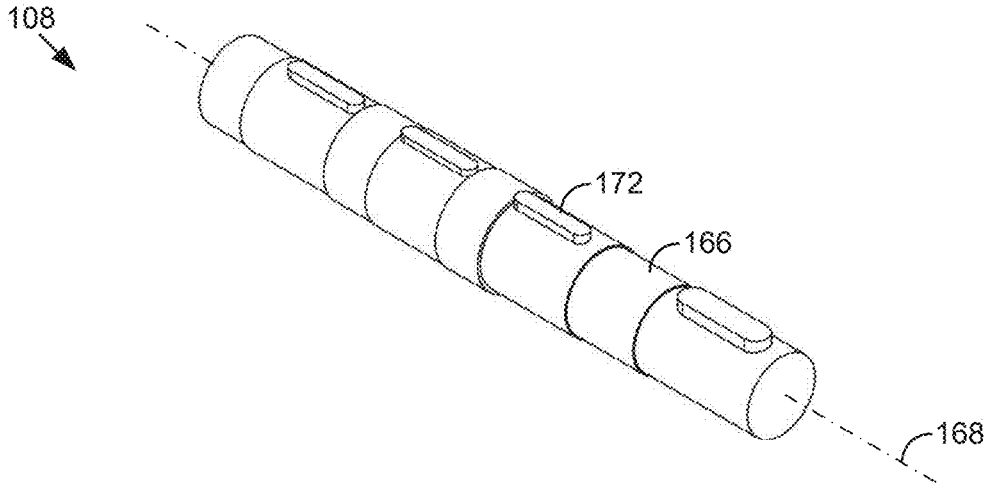
FIG. 12 is a perspective view of another crankshaft axle of a crankshaft usable with the piston pump of FIG. 2.

Optionally, as best exemplified in FIG. 10C showing a front view of the crankshaft 108 with the cams 110 connected to the crankshaft axle 166 of FIGS. 10A and 10B, each cam 110 may be connected to the crankshaft axle 166 at a different angular orientation than at least one other cam 110 connected to the crankshaft axle 166. As exemplified in FIGS. 10A and 10B, the different angular orientations may be achieved by each cam securement pin 174 extending from the crankshaft axle 166 at a different angular orientation than at least one other cam securement pin 174. In such examples, the cam lock recess 174 within the central opening 170 of each cam 110 may be at generally the same location for each cam 110 (e.g., at the example location shown in FIG. 7, 8, or 9). Alternately, as exemplified in FIGS. 11A to 11C, the different angular orientations may be achieved by different locations of the cam lock recess 174 within the central opening 170 of each cam 110 (shown as ellipsoid cams, but any other cam shape may be used). In such examples, as exemplified in FIG. 12, the cam securement pins 174 extending from the crankshaft axle 166 may extend from the crankshaft axle 166 at generally the same angular orientation. That is, the cam securement pins 174 may be arranged in a line or row along the crankshaft axle 166. Optionally, in embodiments where the cam securement pins 174 are arranged in a row, a single elongated cam securement pin may alternately be used.

Positioning the cams 110 at different angular orientations may cause each piston 104 to move out of sync with at least one other piston 104. This may advantageously generate a steadier flow of fluid pumped by the piston pump 100, avoiding pulsations/discontinuities in the flow. Another advantage of this design is that the timing at which each piston 104 transitions between the suction stroke and the discharge stroke may be offset, which may reduce vibrations of the piston pump 100 in operation. In other embodiments, each cam 110 may be connected to the crankshaft axle 166 at the same angular orientation as one or more (or all) other cams 110 connected to the crankshaft axle 166.

Referring again to FIGS. 7 to 9, each cam 110 has a plurality of cam noses 178 and a plurality of cam heels 180. As shown, the cam noses 178 may circumferentially alternate with the cam heels 180 around the crankshaft axis 168. That is, each cam nose 178 may be flanked by two adjacent cam heels 180. The midpoint of each cam nose 178 may be equally circumferentially spaced from the midpoint of each of the adjacent cam heels 180. Similarly, each cam heel 180 may be flanked by two adjacent cam noses 178. The midpoint of each cam heel 180 may be equally circumferentially spaced from the midpoint of each of the adjacent cam noses 178.

The circumferential spacing may depend on the total number of cam noses and heels 178, 180 (i.e., 360-degrees divided by the total number of cam noses and heels 178, 180). This may further depend on the particular non-circular shape of the cam 110. For example, the ellipsoid cam 110 of FIGS. 7A and 7B has four total cam noses and heels 178, 180 (combined), and the midpoint of each cam nose 178 and cam heel 180 is circumferentially spaced 90-degrees from the midpoint of each adjacent cam nose 178 or cam heel 180. As another example, the triangular cam 110 of FIGS. 8A and 8B has six total cam noses and heels 178, 180 (combined), and the midpoint of each cam nose 178 and cam heel 180 is circumferentially spaced 60-degrees from the midpoint of each adjacent cam nose 178 or cam heel 180. As another example, the square cam 110 of FIGS. 9A and 9B has eight total cam noses and heels 178, 180 (combined), and the midpoint of each cam nose 178 and cam heel 180 is circumferentially spaced 45-degrees from the midpoint of each adjacent cam nose 178 or cam heel 180. In other embodiments, the midpoint of each cam nose 178 may be unequally circumferentially spaced from the midpoint of each of the adjacent cam heels 180 and the midpoint of each cam heel 180 may be unequally circumferentially spaced from the midpoint of each of the adjacent cam noses 178.

The use of non-circular cams 110 may advantageously increase the number of strokes of the pistons 104 driven by the cams 110 per revolution of the crankshaft 108, where the suction stroke occurs when the portion of the cam 110 sliding on the piston crown 112 transitions from cam nose 178 (referred to herein as the piston being in the nose position) to cam heel 180 (referred to herein as the piston being in the heel position) and, conversely, the discharge stroke occurs when the portion of the cam 110 sliding on the piston crown 112 transitions from cam heel 180 to cam nose 178. In such embodiments, each piston 104 may perform at least four strokes per revolution of the crankshaft 108 (e.g., a first stroke and subsequent odd numbered strokes each being one of the suction stroke and the discharge stroke, and a second stroke and subsequent even numbered strokes being the other of the suction stroke and the discharge stroke).

Figure 13B:
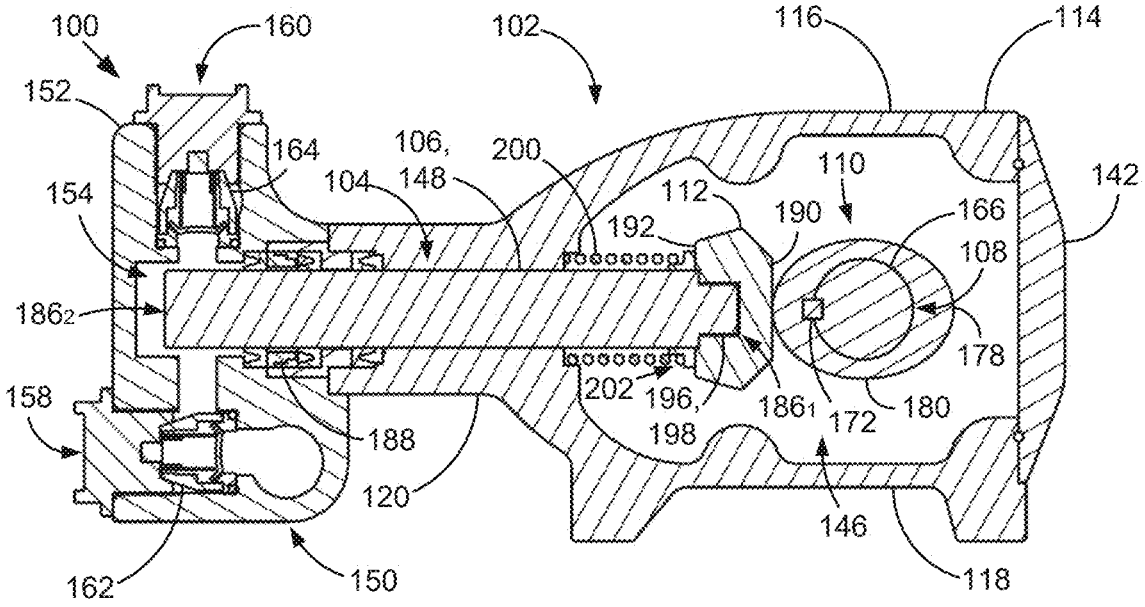
FIG. 13B is a side cross-sectional view taken along line 13-13 in FIG. 2 with the piston in a nose position with the ellipsoid cam.
Figure 14A:
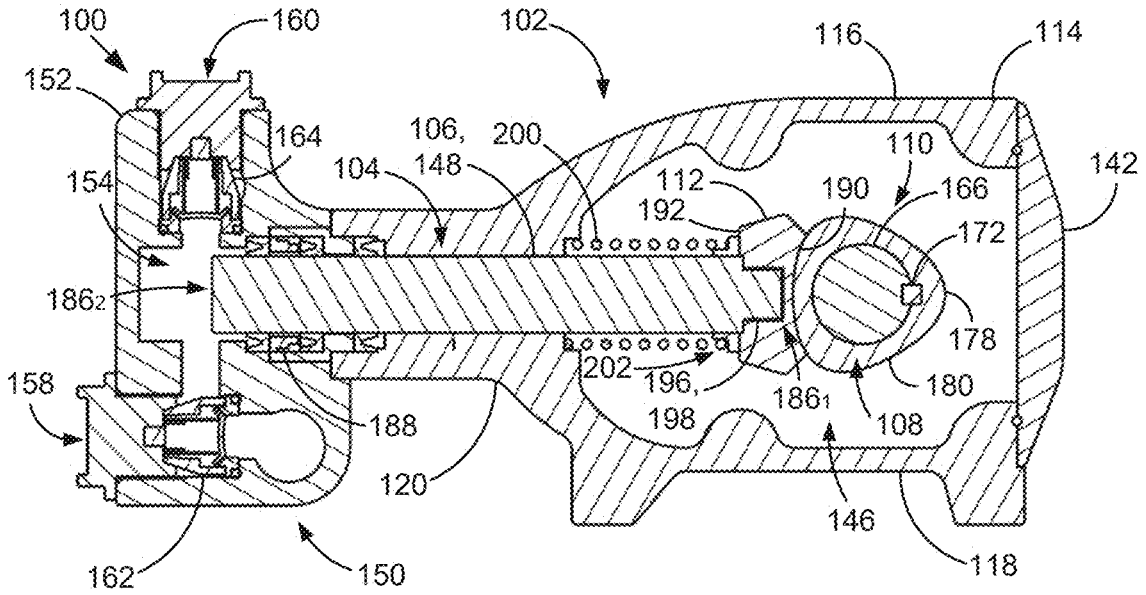
FIG. 14A is a side cross-sectional view taken along line 13-13 in FIG. 2 with the piston in the heel position with a triangular cam.
Figure 14B:
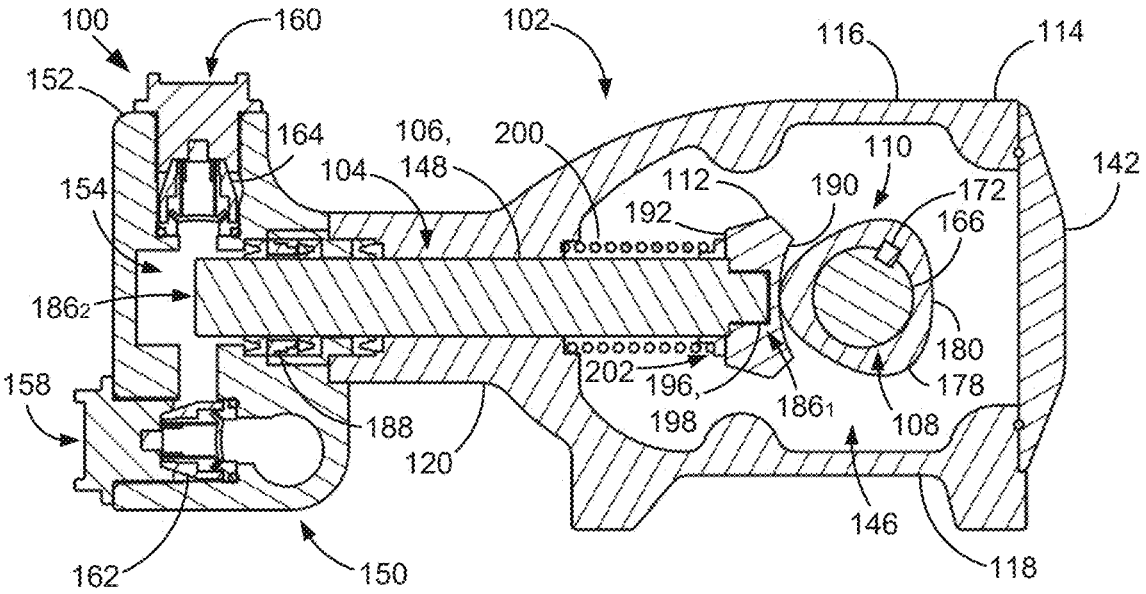
FIG. 14B is a side cross-sectional view taken along line 13-13 in FIG. 2 with the piston in the nose position with the triangular cam.
Figure 15A:
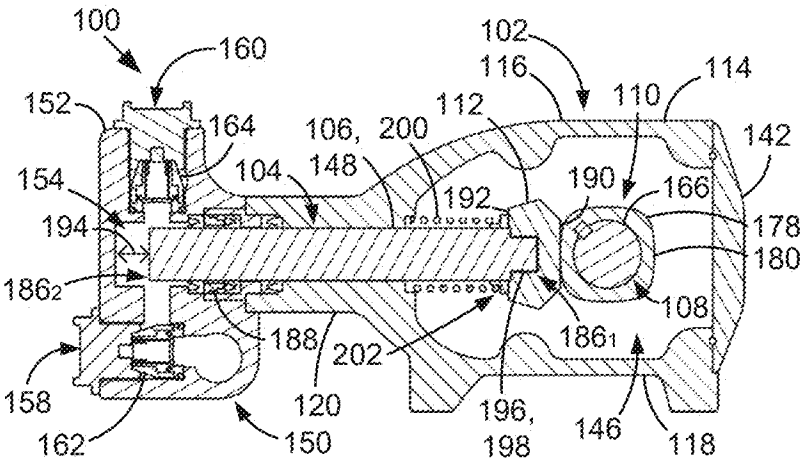
FIG. 15A is a side cross-sectional view taken along line 13-13 in FIG. 2 with the piston in the heel position with a square cam.
Figure 15B:
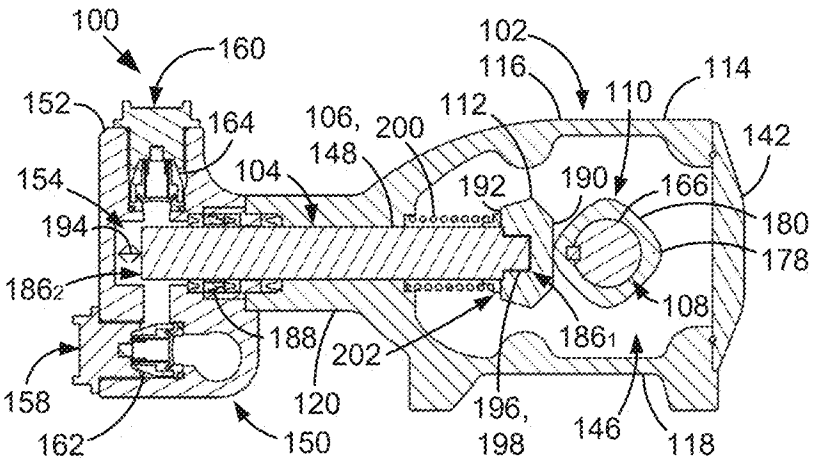
FIG. 15B is a side cross-sectional view taken along line 13-13 in FIG. 2 with the piston in the nose position with the square cam.
Figure 15C:
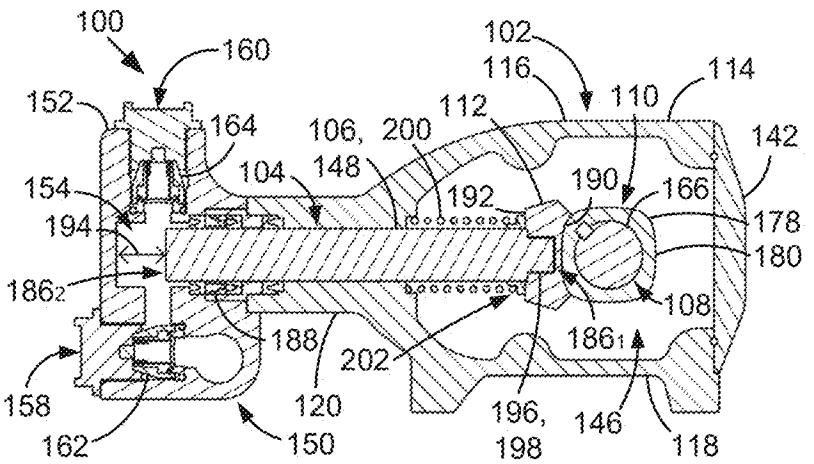
FIG. 15C is a side cross-sectional view taken along line 13-13 in FIG. 2 with the piston in the heel position with the square cam and the piston being eroded.
Figure 15D:
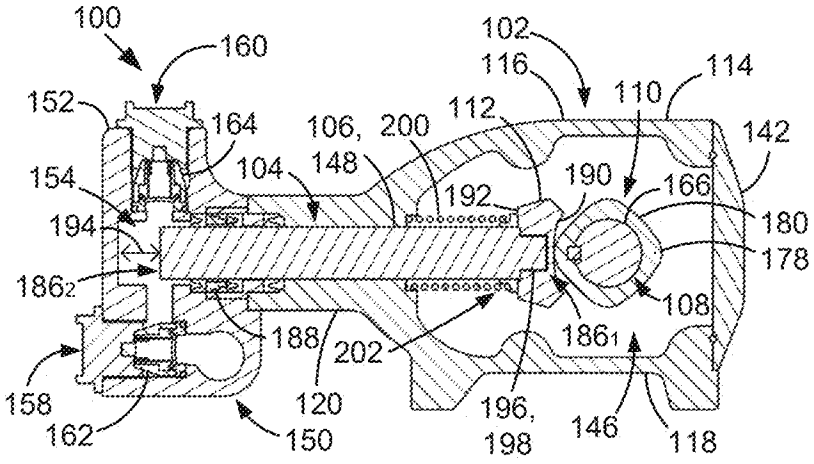
FIG. 15D is a side cross-sectional view taken along line 13-13 in FIG. 2 with the piston in the nose position with the square cam and the piston being eroded.

For example, as shown in FIGS. 13A and 13B, when the piston pump 100 uses ellipsoidal cams 110 the pistons 104 may move between the heel position (FIG. 13A) and the nose position (FIG. 13B) four times per revolution of the crankshaft 108 (i.e., once every 90-degrees), and thus perform 4 strokes per revolution of the crankshaft 108 (two suction strokes and two discharge strokes). As another example, as shown in FIGS. 14A and 14B, when the piston pump 100 uses triangular cams 110 the pistons 104 may move between the heel position (FIG. 14A) and the nose position (FIG. 14B) six times per revolution of the crankshaft 108 (i.e., once every 60-degrees), and thus perform 6 strokes per revolution of the crankshaft 108 (three suction strokes and three discharge strokes). As another example, as shown in FIGS. 15A and 15B, when the piston pump 100 uses square cams 110 the pistons 104 may move between the heel position (FIG. 15A) and the nose position (FIG. 15B) eight times per revolution of the crankshaft 108 (i.e., once every 45-degrees), and thus perform 8 strokes per revolution of the crankshaft 108 (four suction strokes and four discharge strokes). Increasing the number of strokes per revolution of the crankshaft 108 may advantageously provide a steadier discharge of the pumping fluid (i.e., by reducing the time between each discharge stroke).

While the cams 110 in the illustrated examples are ellipsoidal, triangular, and square, it will be appreciated that any other shape may be possible, such as pentagonal, hexagonal, or octagonal, for example, which may further alter the number of strokes per revolution of the crankshaft 108. It will be appreciated that, while the cam shapes are identified by the geometric shape that their cross-section most closely resembles, the cam noses 178, which correspond to the vertices of those geometric shapes, are rounded. The cam heels 180, which correspond to the edges of those geometric shapes, may be flat or, optionally, may also be rounded (i.e., outwardly rounded; convex) as exemplified in FIGS. 7 to 9.

Figure 7A:
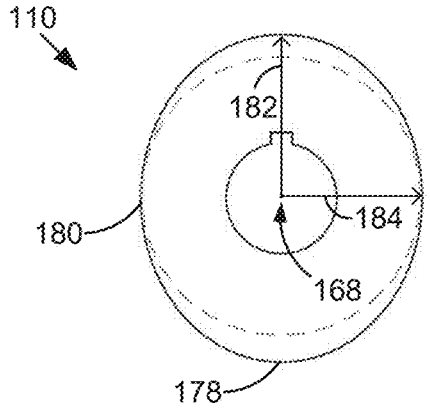
FIG. 7A is a front view of an example ellipsoid cam usable with the piston pump of FIG. 2.
Figure 7B:
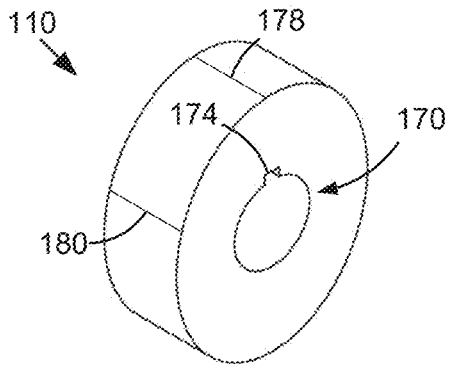
FIG. 7B is a perspective view of the ellipsoid cam of FIG. 7A.
Figure 8A:
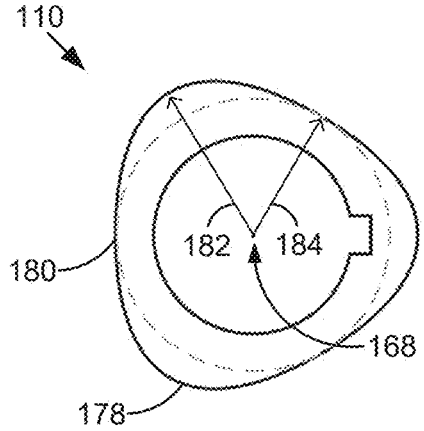
FIG. 8A is a front view of an example triangular cam usable with the piston pump of FIG. 2.
Figure 8B:
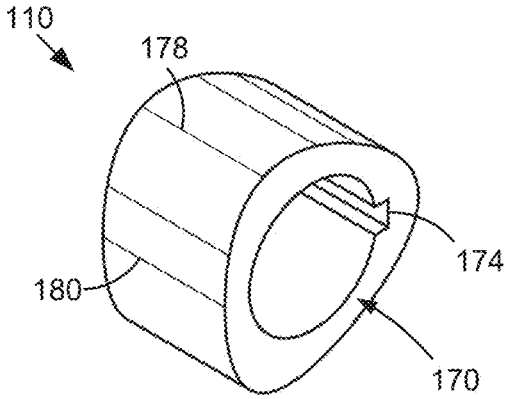
FIG. 8B is a perspective view of the triangular cam of FIG. 8A.
Figure 9A:
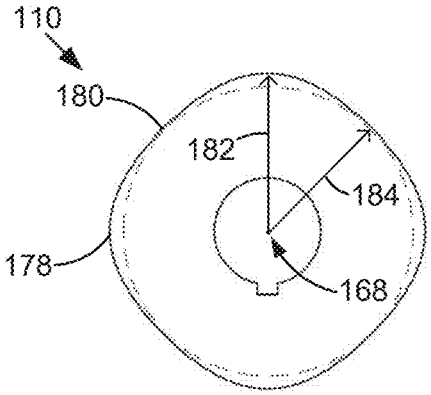
FIG. 9A is a front view of an example square cam usable with the piston pump of FIG. 2.
Figure 9B:
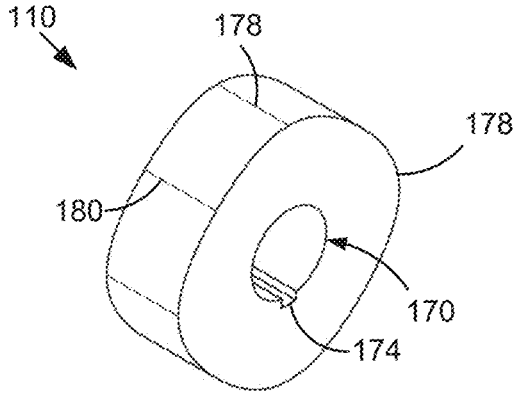
FIG. 9B is a perspective view of the square cam of FIG. 9A.

Referring to FIGS. 7 to 9, as shown, each cam nose 178 may have a nose radius 182 and each cam heel 180 may have a heel radius 184. The nose radius 182 may be greater than the heel radius 184. While the cams 110 themselves are non-circular, the nose radius 182 may be conceptually understood as the radius of a circle measured from the crankshaft axis 166 (i.e., when the cam 110 is connected to the crankshaft axle 166) to the outermost point of the cam nose 178 (i.e., the midpoint). Similarly, the heel radius 184 may be conceptually understood as the radius of a circle measured from the crankshaft axis 166 to the outermost point of the cam heel 180 (i.e., the midpoint, if rounded). For example, a circle having the heel radius 184 is shown in stippled lines over the cam 110 in each of FIGS. 7A, 8A, and 9A. As exemplified by the stippled circle, the outermost point of each cam heel 180 may be the same distance (i.e., the heel radius 184) from the crankshaft axis 166. Similarly, the outermost point of each cam nose 178 may be the same distance (i.e., the nose radius 182) from the crankshaft axis 166. In other embodiments, each cam nose 178 may have a different nose radius 182 than at least one other cam nose 178 and/or each cam heel 180 may have a different heel radius 184 than at least one other cam heel 180.

Each cam 110 has a cam stroke length which, as used herein and in the claims, is the difference between the nose radius 182 and the heel radius 184. The cam stroke length determines the amount of displacement of the piston 104 through the suction and discharge strokes and may thus affect the volume of fluid pumped for each discharge stroke. Accordingly, increasing the number of strokes per revolution of the crankshaft 108 may also affect the pumping volume of the piston pump 100. In other embodiments, each cam 110 may have more than one cam stroke length, such as where each cam nose 178 has a different nose radius 182 than at least one other cam nose 178 and/or each cam heel 180 has a different heel radius 184 than at least one other cam heel 180.

A traditional piston assembly such as the example illustrated in FIGS. 1A to 1D performs one discharge stroke having a discharge stroke length per revolution of the crankshaft. In contrast, a cam 110 in accordance with this disclosure may perform two (see e.g., FIGS. 13A to 13B), three (see e.g., FIGS. 14A to 14B), four (see e.g., FIGS. 15A to 15B), or more than four discharge strokes per revolution of the crankshaft 108. Accordingly, a cam 110 in accordance with this disclosure having a cam stroke length equal to the discharge stroke length of a traditional piston assembly, if used with a piston of equal diameter and operated at the same rate of rotation as the traditional piston assembly, may pump two, three, four, or more than four times the volume per revolution of the crankshaft 108 than the traditional piston assembly. As such, for the same power input to drive rotation of the crankshaft 108 as a traditional piston assembly, the volume of fluid pumped per piston 104 of the piston pump 100 may be double, triple, quadruple, or more than quadruple that of the traditional piston assembly. This may depend on the cross-sectional shape of the cam 110. Stated from another perspective, the piston pump 100 may pump the same volume of fluid per piston 104 as the traditional piston assembly using one half, one third, one fourth, or less than one fourth of the power input to drive rotation of the crankshaft 108. Again, this may depend on the cross-sectional shape of the cam 110.

Referring again to FIGS. 7 to 9, as exemplified, each differently shaped cam 110 may have a cam convexity characteristic of greater than 1 and less than 1.5 (e.g., less than 1.5, 1.45, 1.4, or 1.35). As used herein and in the claims, the cam convexity characteristic may be understood as the ratio of the nose radius 182 to the heel radius 184. Where the cam 110 has a cam convexity characteristic within this range, it may be referred to as near-circular. A cam 110 having a cam convexity characteristic within this range, and thus being near-circular, may advantageously smooth the transition as the piston 104 moves between the nose position and the heel position. That is, a near-circular cam 110 may have a narrower difference between the nose radius 182 and the heel radius 184. This may allow the cam 110 to slide more smoothly on the piston crown 112 engaged therewith as the piston 104 transitions between the nose position and the heel position. Smoother sliding may reduce vibration of the piston pump 100 during operation. Reduced vibration may prevent premature failure of the piston pump 100 or the components thereof commonly caused by excessive vibration (e.g., cracking of components, loosening of bolts 132 leading to leaks) and/or reduce noise produced by the piston pump 100. Cams 110 having a cam convexity characteristic within this range, and thus being near-circular, may also advantageously experience less frictional resistance while sliding on the piston crown 112 engaged therewith. Reduced frictional resistance may correspondingly reduce power input required to rotate the crankshaft 108 and/or reduce the rate of erosion of the piston crown 112, which may extend its service life. Another advantage is that cams 110 having a cam convexity characteristic within this range may be able to withstand higher operational forces and may better transfer those forces to/from the piston 104. That is, the total force transferred from the cams 110 that is required to drive the pistons 104 through the discharge stroke may be substantially axially aligned with the piston shaft 106. The downward/upward force component described previously herein that is transverse to the longitudinal dimension of the pistons 104 may accordingly be minimized or eliminated.

The cams 110 may be made of any suitable metal or metal alloy, including one or more of iron, steel, stainless steel, titanium, and aluminum. In the illustrated examples, the cams 110 are made of steel or titanium. Steel and titanium may be advantageous due to the material properties thereof, such as high strength suitable for withstanding and transferring operational forces from the pistons 104 to the crankshaft axle 166. Another advantageous material property is the high abrasion resistance of steel and titanium (i.e., resistance to the surface being worn away by rubbing or friction), which may be further enhance by any suitable abrasion-resistance surface treatment (e.g., nitriding). In particular, the abrasion resistance of the cam material may be greater than that of the crown material of the piston crowns 112. This may result in the piston crowns 112 eroding over time by the cams 110 sliding thereon. Consequently, this may prevent or minimize erosion of the cams 110. Accordingly, as described in greater detail subsequently herein, the cam material abrasion resistance being greater than the crown material abrasion resistance may preserve the cam stroke length and thus the pumping volume of the piston pump 100 through time. In other embodiments, the cams 110 may not have a greater cam material abrasion resistance than the crown material abrasion resistance.

While the cams 110 may be manufactured by any suitable method such as forging or casting, the cams 110 may be advantageously manufactured by extrusion, which may confer similar benefits to those described above with respect to extrusion of the pump main housing 102. In particular, extrusion may advantageously enable a high degree of control of the cam material properties described previously. Optionally, the cams 110 may be extruded with the central opening 170 (and cam lock recess 174, if present). Alternately, the cams 110 may be extruded as a solid non-circular profile, and the central opening 170 (and cam lock recess 174, if present) may be subsequently machined.

In other embodiments, piston pump 100 may not have non-circular cams 110. For example, the crankshaft 108 of the piston pump 100 may be a conventional crankshaft, such as in the example traditional piston assembly of FIGS. 1A to 1D. In such embodiments, operation of the piston pump 100 may be improved by one or more other features described herein. For example, the piston crowns 112 may be engaged with an eccentric crankshaft having a greater material hardness than that of the piston crowns 112 such that the stroke length and thus the pumping volume of the piston pump 100 may be preserved over time.

Referring to FIGS. 13 to 15, in the illustrated examples, each piston 104 of the piston pump 100 includes a piston shaft 106 extending from a first shaft end $\mathbf{186}_1$ to a second shaft end $\mathbf{186}_2$. As shown, the piston shaft 106 may be slidably mounted in a corresponding piston passage 148 of the piston 104 between the nose position and the heel position. Each piston passage 148 may include a piston seal 188 at any location therein (e.g., proximate the rear wall 120, proximate the working chamber 154, or any other location therebetween). The piston shaft 106 of the piston 104 slidably mounted in each piston passage 148 may extend through the piston seal 188 therein. The piston seal 188 may prevent leaking between the piston seal 188 and the piston shaft 106 as the piston 104 alternates between the nose position and the heel position.

As shown, the piston shaft 106 may have a unitary construction of solid metal, which may eliminate the failures modes common to two-piece piston rods described previously herein with respect to FIGS. 1A to 1D, such as those commonly caused by use of a ceramic plunger. The piston shaft 106 may be made of any suitable metal or metal alloy, including one or more of iron, steel, stainless steel, titanium, and aluminum, and may be manufactured by any suitable method such as forging, casting, extrusion, or may be machined from a round stock rod of suitable diameter. The piston shaft 106 may be any suitable diameter, which may depend, for example, on the material of the piston shaft 106 and/or the maximum pressure at which the piston pump 100 is designed to operate. In the illustrated examples, the piston shaft 106 is made of titanium, which may be advantageous due to the material properties thereof. For example, titanium is light weight, which may reduce overall weight of the piston pump 100, and has a high abrasion resistance, which may extend the service life of the piston shaft 106. Titanium may also be subject to processes that may extend service of the piston shaft 106 life by 2 to 3 times or more by minimizing/slowing the rate of erosion of the piston shaft 106. Such processes may include, for example, superfine polishing to produce a mirror-like finish on an exterior surface of the piston shaft 106, which may reduce friction between the piston shaft 106 and the piston seal 188, and abrasion-resistance surface treatments, which may improve abrasion resistance of the exterior surface. Any suitable abrasion-resistance surface treatment (e.g., nitriding) may be used. For example, in the illustrated example, the piston shaft 106 has an abrasion-resistance surface treatment such that the exterior surface of the piston shaft 106 has an abrasion resistant titanium nitride layer formed therein. In other embodiments, the piston shaft 106 may be any other material, having any suitable diameter and material properties, and optionally subject to any suitable processes to may extend service thereof.

At least a portion of the exterior surface of the piston shaft 106, having any length, may have an abrasion-resistance surface treatment. For example, in operation, the exterior surface of a portion of the piston shaft 106 may be continually engaged with the piston seal 188 as the piston 104 alternates between the nose position and the heel position. The length of the portion of the piston shaft 106 that may be continually engaged with the piston seal 188 may correspond to the cam stroke length. Accordingly, at least the portion of the piston shaft 106 that may be continually engaged with the piston seal 188 and having the cam stroke length may have an abrasion-resistance surface treatment to an exterior surface thereof. The position of the portion may shift toward the second shaft end $\mathbf{186}_2$ over time due to erosion of the piston crown 112 (expanded upon subsequently). Accordingly, the length of the portion having the abrasion-resistance surface treatment to an exterior surface thereof may optionally be greater than the cam stroke length to account for erosion of the piston crown 112 over time. In other embodiments, none of the exterior surface of the piston shaft 106 may have an abrasion-resistance surface treatment. In other embodiments, substantially all of the exterior surface of the piston shaft 106 may have an abrasion-resistance surface treatment.

Referring still to FIGS. 13 to 15, as shown, the first shaft end $\mathbf{186}_1$ of the piston shaft 106 may be positioned in the crankshaft chamber 146. As shown, the piston crown 112 of each piston 104 may be connected to the first shaft end $\mathbf{186}_1$ and engaged with a corresponding cam 110. In alternate embodiments, the piston crowns 112 may be omitted and the first shaft end $\mathbf{186}_1$ of the pistons 104 may be engaged with a corresponding cam 110. In such embodiments, the first shaft end $\mathbf{186}_1$ may have any configuration, properties, or functions as described herein with respect to the piston crowns 112. The second shaft end $\mathbf{186}_2$ may be positioned proximate a corresponding working chamber 154, where displacement of the second end $\mathbf{186}_2$ relative to the working chamber 154 may generate flow of the pumping fluid through the working chamber 154. That is, when the piston 104 moves from the nose position to the heel position (i.e., the suction stroke), the second shaft end $\mathbf{186}_2$ may be pulled away from the working chamber 154, thereby drawing fluid into the working chamber 154 through the intake port 158. Conversely, when the piston 104 moves from the heel position to the nose position (i.e., the discharge stroke), the second shaft end $\mathbf{186}_2$ may be pushed into the working chamber 154, thereby driving fluid out of the working chamber 154 through the outlet port 160.

Accordingly, the volume of fluid pumped per stroke of the piston 104 may depend on the cross-sectional area of the piston shaft 106 and the distance the second shaft end $\mathbf{186}_2$ is displaced (i.e., the cam stroke length). This may be characterized by the convexity-size attribute which, as used herein and in the claims, may be understood as the diameter of the piston shaft 106 divided by the cam convexity characteristic. Each piston 104 may have a convexity-size attribute greater than 3 mm. A piston 104 having a convexity-size attribute greater than 3 mm may have a relatively large diameter (and thus a relatively large cross-sectional area) and the cam 110 driving the piston 104 may have a relatively short cam stroke length. Accordingly, it may be advantageous for a piston 104 to have a convexity-size attribute greater than 3 mm to generate a relatively high pumping volume per stroke even with a relatively short stroke length. A shorter stroke length may confer the advantages described previously herein with respect to the cams 110.

Referring still to FIGS. 13 to 15, as shown, the piston crown 112 of the piston 104 may have a cam engagement side 190 for engaging the corresponding cam 110, and a shaft engagement side 192 opposite the cam engagement side 190 for connecting to the first shaft end $\mathbf{186}_1$. The cam engagement side 190 may be the surface of the piston crown 112 in constant contact with the cam 110 and on which the cam 110 slides during rotation of the crankshaft 108. As shown, each piston 104 may be in the nose position when the cam engagement side 190 of the piston crown 112 is in contact with the cam nose 178 of the corresponding cam 110 of the piston 104, and each piston 104 may be in the heel position when the cam engagement side 190 of the piston crown 112 is in contact with the cam heel 180 of the corresponding cam 110 of the piston 104.

As exemplified in FIGS. 13A and 13B, the cam engagement side 190 may be a flat sliding surface. A flat cam engagement side 190 may advantageously be useable with any cam 110 of any shape and size in accordance with this disclosure, which may permit different cams 110 to be used interchangeably within the same piston pump 100. Alternately, as exemplified in FIGS. 14A and 14B, the cam engagement side 190 may be a curved sliding surface (i.e., inwardly curved; concave). A curved cam engagement side 190 may advantageously match the curvature of the cam heel 180 of the cam 110 with which it is to be used, which may result in smoother sliding transitions between the nose position and the heel position, reduced vibrations, and improved transfer of operational forces between the piston 104 and the cam 110.

In any example, the piston crowns 112 may be sacrificial piston crowns 112 where the cam engagement side 190, and optionally the whole of each piston crown 112, has a crown material abrasion resistance that is less than the cam material abrasion resistance of the cams 110. Due to the difference in abrasion resistance, erosion (i.e., being worn away by rubbing or friction) caused by the sliding engagement of the cams 110 on the cam engagement side 190 of the piston crowns 112 may be substantially concentrated to the cam engagement side 190. In this way, erosion of the cams 110 may be minimized or eliminated. An advantage of this design is that the cam stroke length of the cams 110, and thus the pumping volume of the piston pump 100, may be maintained over time. For example, the pumping volume of the piston pump 100 may be maintained across the service life of one or more piston crowns 112 and/or seals 188. That is, as long as cams 110 remain in same dimensions as manufactured, erosion of the piston crowns 112 may not reduce the pumping volume of the piston pump 100. Therefore, power input required to maintain the same pumping volume may remain constant over time. In contrast, as explained with reference to FIGS. 1A to 1D, in traditional piston assemblies when connecting rods are eroded due to abrasion, pumping volume is reduced proportionally to the level of lost material on connecting rods. Accordingly, traditional piston assemblies require greater power input over time to increase the rate or rotation of the crankshaft in order to maintain the same pumping volume. In other embodiments, the piston crowns 112 may not be sacrificial piston crowns.

As exemplified in FIGS. 15A to 15D, the cam engagement side 190 of the piston crown 112 may have a crown material abrasion resistance that is less than the cam material abrasion resistance of the cam 110. As exemplified in FIGS. 15A and 15B, early in the service life of the piston crown 112, the cam engagement side 190 may be flat. As exemplified in FIGS. 15C and 15D, later in the service life, the cam engagement side 190 may be concave due to material being gradually worn away over time by rubbing or friction caused by the sliding engagement of the cam 110 on the cam engagement side 190 of the piston crown 112. However, the cam stroke length of the cam 110 as shown, represented in the illustrated example by the difference of a spacing 194 of the second shaft end $186_2$ from a rear wall of the working chamber 154 between the cam nose position (FIGS. 15B and 15D) and the cam heel position (FIGS. 15A and 15C), may be substantially the same for when the cam engagement side 190 of the piston crown 112 is flat as it is when the cam engagement side 190 of the piston crown 112 has been eroded.

The shaft engagement side 192 of the piston crown 112 may be rigidly connected to the first shaft end $186_1$ by any suitable means, such as permanently (e.g., by welding) or removably (e.g., by one or more fasteners). In some examples, such as those shown, the piston crown 112 may include a bore 196 in the shaft engagement side 192 shaped to receive the first shaft end $186_1$. The bore 196 may strengthen the connection of the piston crown 112 to the first shaft end $186_1$. In such examples, after inserting the first shaft end $186_1$ into the bore 196 in the shaft engagement side 192, the piston crown 112 may be connected to the first shaft end $186_1$ by any suitable means, such as permanently (e.g., by welding), or removably (e.g., by one or more fasteners, adhesive, or held in a friction fit between the bore 196 and the first shaft end $186_1$). As shown in the illustrated examples, the bore 196 may be an internally threaded bore, the piston shaft 106 may have a threaded portion 198 extending from the first shaft end $186_1$ toward the second shaft end $186_2$, and the piston crown 112 may be removably connected to the first shaft end $186_1$ by threadably connecting the internally threaded bore 196 to the threaded portion 198 of the piston shaft 106 at the first shaft end $186_1$. In other embodiments, the piston crown 112 may not have the bore 196. In other embodiments, the piston crown 112 may be integrally formed with the piston shaft 106 at the first shaft end $186_1$.

The piston crowns 112 may be made of any suitable metal or metal alloy, including one or more of iron, steel, stainless steel, titanium, and aluminum. Aluminum may be advantageous due to the material properties thereof, such as being light weight and having a lower abrasion resistance than steel and titanium (i.e., the cam material), which may ensure that the piston crowns 112 erode in favor of the cams 110. Steel and titanium may be advantageous due to the material properties thereof, such as high strength suitable for withstanding and transferring operational forces from the pistons 104 to the cams 110. The abrasion resistance of aluminum, steel, and titanium may be enhanced by any suitable abrasion-resistance surface treatment (e.g., nitriding) to a degree such that the abrasion resistance of the crown material remains less than that of the cam material of the cams 110. In this way, the piston crowns 112 may still erode in favor of the cams 110 but at a slower rate such that the service life of the piston crowns 112 may be extended. In other embodiments, the material properties of the piston crowns 112 and/or the cams 110 may be predetermined and controlled such that subsequent modification by abrasion-resistance surface treatments may be omitted.

While the piston crowns 112 may be manufactured by any suitable method such as forging or casting, the cams 110 may be advantageously manufactured by extrusion, which may confer similar benefits to those described above with respect to extrusion of the pump main housing 102. In particular, extrusion may advantageously enable a high degree of control of the crown material properties described previously. Optionally, after the piston crowns 112 have been extruded as a solid non-circular profile, the bore 196 may be machined into the shaft engagement side 192. In other embodiments, the piston crowns 112 may be manufactured by means other than extrusion, and the bore 196 may optionally be formed at the same time as the piston crown 112.

Referring to FIGS. 3, 6, and 13 to 15, in the illustrated examples, the piston pump 100 includes a plurality of resiliently compressible piston biases 200. As shown, each piston bias 200 may bias a corresponding piston 104 toward the crankshaft 108. In this way, the piston biases 200 may maintain constant contact between the cam engagement side 190 of the piston crowns 112 and the corresponding cam 110 as the crankshaft 108 rotates and the pistons 104 move between the nose position (see e.g., FIGS. 13B, 14B, 15B) and the heel position (see e.g., FIGS. 13A, 14A, 15A). Any resiliently compressible bias may be used that is suitable for maintaining constant contact between the cam engagement side 190 of the piston crowns 112 and the corresponding cam 110. As shown in the illustrated example, the piston biases 200 may be resiliently compressible springs. As shown, the piston biases 200 may be positioned around the piston shaft 106 between each piston crown 112 and the corresponding piston passage 148. In operation, as the pistons 104 alternate between the nose position and the heel position, the piston biases 200 may be compressed between the shaft engagement side 192 of each piston crown 112 and the rear wall 120 of the pump main housing 200. Optionally, the shaft engagement side 192 may include a bias seat 202 machined therein, shown as around the bore 196 in the illustrated examples, which may help maintain the position of the piston bias 200 around the piston shaft 106 to avoid contact and unnecessary abrasion therebetween. The piston biases 200 may have any other positioning suitable for biasing the pistons 104 toward the crankshaft 108 and maintaining contact between the piston crowns 112 and the cams 110.

Figure 16A:
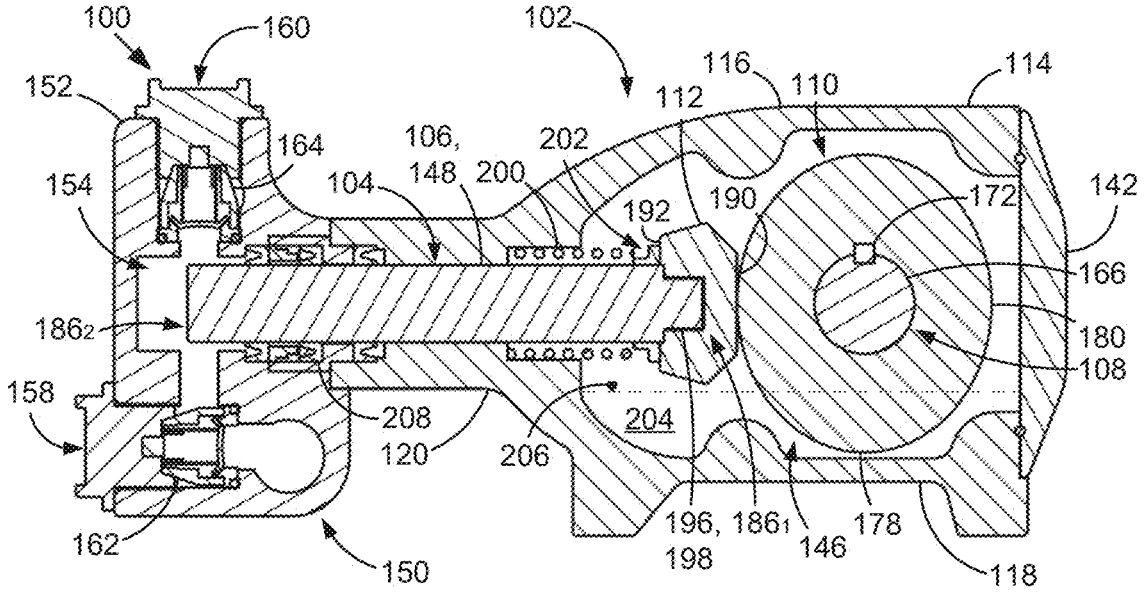
FIG. 16A is a side cross-sectional view taken along line 13-13 in FIG. 2 with the piston in with the heel position with a large ellipsoid cam.
Figure 16B:
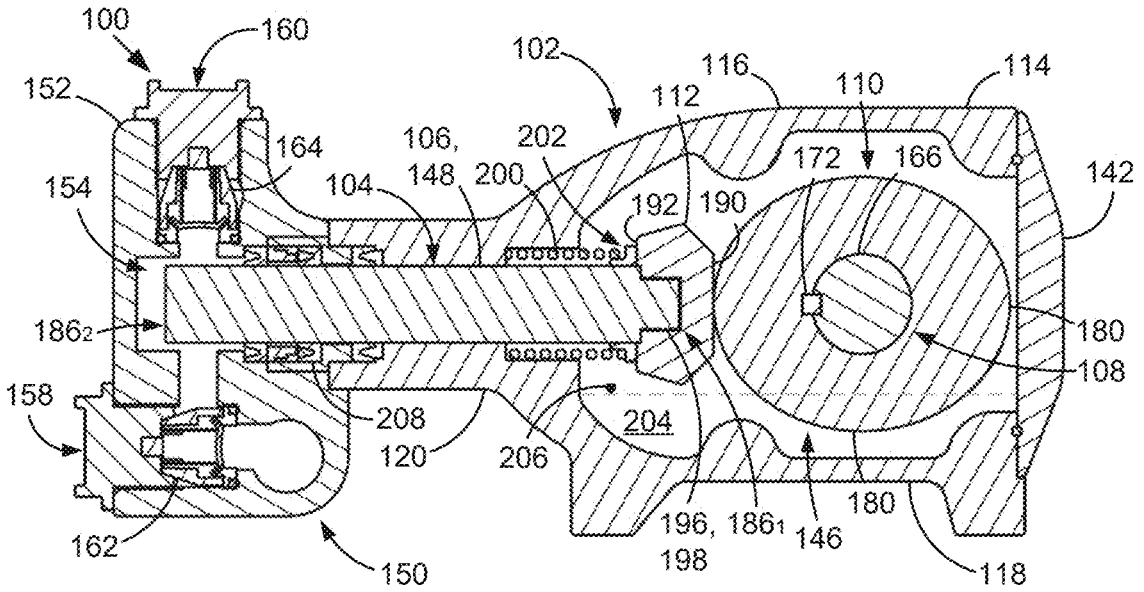
FIG. 16B is a side cross-sectional view taken along line 13-13 in FIG. 2 with the piston in the nose position with the large ellipsoid cam.

Referring now to FIGS. 16A and 16B, as shown, the piston pump 100 may include a lubricating oil 204 within the crankshaft chamber 146. The lubricating oil 204 may lubricate the cams 110 and the cam engagement side 190 of the piston crowns 112, which may reduce friction during sliding engagement therebetween. Reduced friction may accordingly reduce the rate of erosion of the piston crowns 112. Optionally, as shown, the lubricating oil 204 may have a surface level 206 at an elevation between the crankshaft axle 166 and the cam heel 180 of one of the cams 110 when that cam heel 180 is oriented downwards below the crankshaft axle 166 (see e.g., FIG. 16B). In such examples, the cams 110 may have a larger nose radius 182 and heel radius 184 than examples wherein the crankshaft chamber 146 has a surface level 206 at the midpoint the crankshaft axle 166 (as is common in traditional piston pumps). In this way, throughout rotation of the crankshaft 108, the cam noses and heels 178, 180 may alternatingly continually dip beneath the surface level 206 of the lubricating oil 204. In this way, the cams 110 may remain sufficiently lubricated to reduce friction as the cams 110 slide along the cam engagement side 190 of the piston crowns 112. Accordingly, the rate of erosion of the piston crowns 112 may be reduced. An advantage of this design is that the surface level 206 of the lubricating oil 204 may sit below the crankshaft passage 134 in the sidewall 122 of the pump housing 102 (see e.g., FIG. 3) and below the piston passages 148 in the rear wall 120 of the pump housing 102. Accordingly, oil seals on the crankshaft 108 and the pistons 104 traditionally required in order to keep lubricating oil 204 from leaking from the crankshaft chamber 146 may be omitted. This may reduce the part count, as well as the time and cost of manufacture. In other embodiments, the surface level 206 of the lubricating oil 204 may be at any other elevation sufficient to lubricate the cam engagement surface 190.

In any example, such as the example shown in FIGS. 16A and 16B wherein the piston shafts 106 sliding within the piston passages 148 may not be lubricated by the lubricating oil 204, the piston pump 100 may include a plurality of bearings 208 (e.g., linear, synthered, and the like). The bearings 208, shown as linear bearings in the illustrated example, may each slidably mount a corresponding piston 104 in the corresponding piston passage 148. In this way, the piston shafts 106 may advantageously be slidable within the piston passages 148 with less frictional resistance and thus less abrasive wear of the piston shaft 106. This may prolong service life of the piston shafts 106, including where the surface level 206 of the lubricating oil 204 is below the piston passages 148.

A piston pump 100 in accordance with this disclosure may have a pumping volume of at least 4 L/min at least at 25 bar when the crankshaft 108 is rotated at up to 20,000 rotations per minute (rpm). For example, the piston pump 100 may have a pumping volume of at least 4 L/min at least at 25 bar when the crankshaft 108 is rotated at 20,000 rpm or less, such as 15,000 rpm or less, or 10,000 rpm or less, or 5,000 rpm or less, or 2,500 rpm or less. As used herein and in the claims, the pumping volume may be understood as the cross-sectional area of the piston shaft 106 multiplied by the cam stroke length, further multiplied by the number of discharge strokes per revolution of the crankshaft 108 (i.e., the total number of cam noses 178), and further multiplied by the number of pistons 104. It will be appreciated from this disclosure that the pumping volume of the piston pump 100 may be adjusted—without adjusting the power input to drive rotation of the crankshaft 108—by increasing or decreasing, for example, the cam stroke length, the number of cam noses 178 (i.e., the number of discharge strokes per revolution of the crankshaft 108), the convexity-size attribute of the piston shaft 106, and/or the number of pistons 104 (and corresponding components, including cams 110, working chambers 154, etc.).

Figure 17:
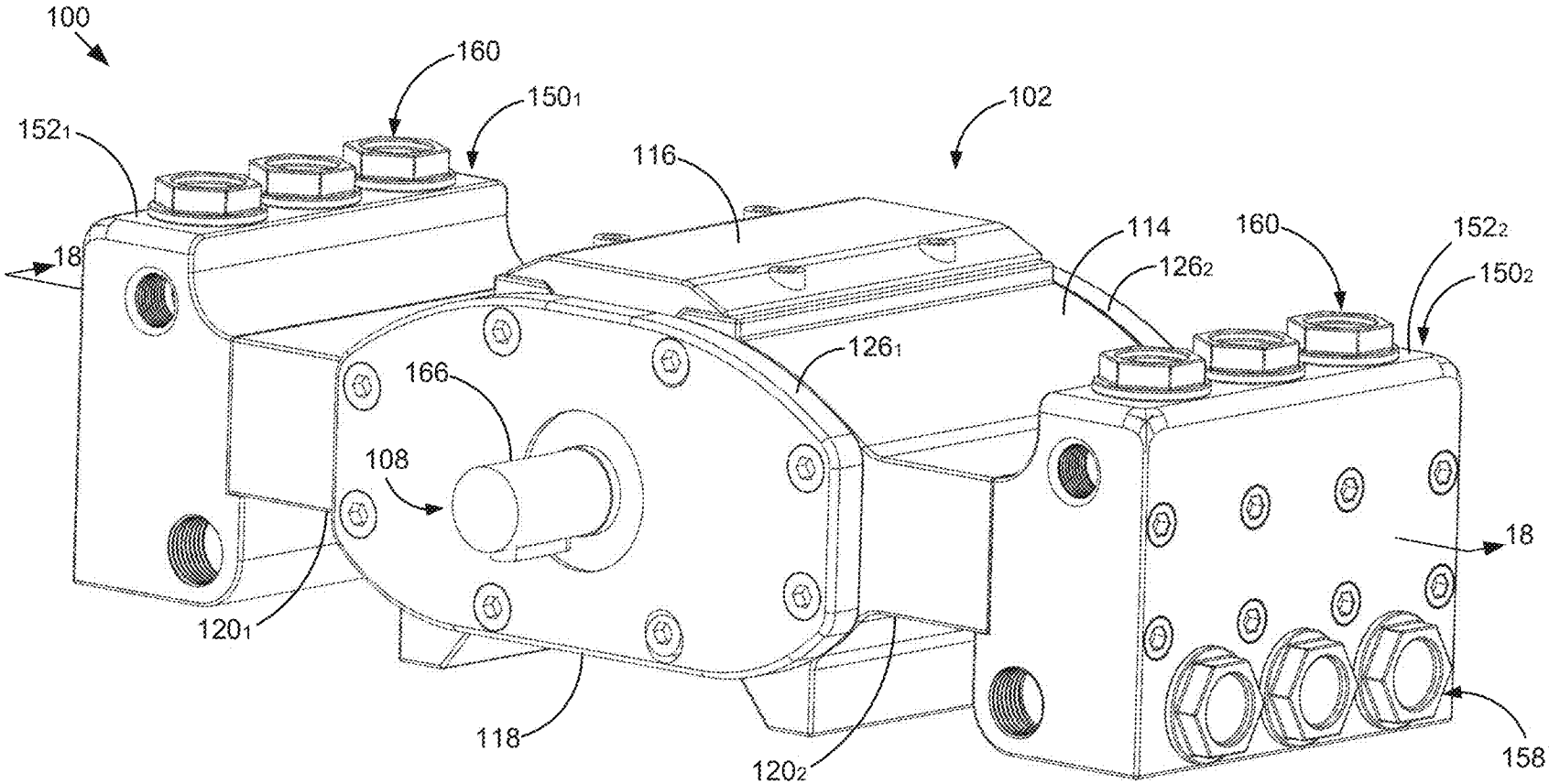
FIG. 17 is a perspective view of the piston pump of FIG. 2 with a first pumping chamber and a second pumping chamber.
Figure 18A:
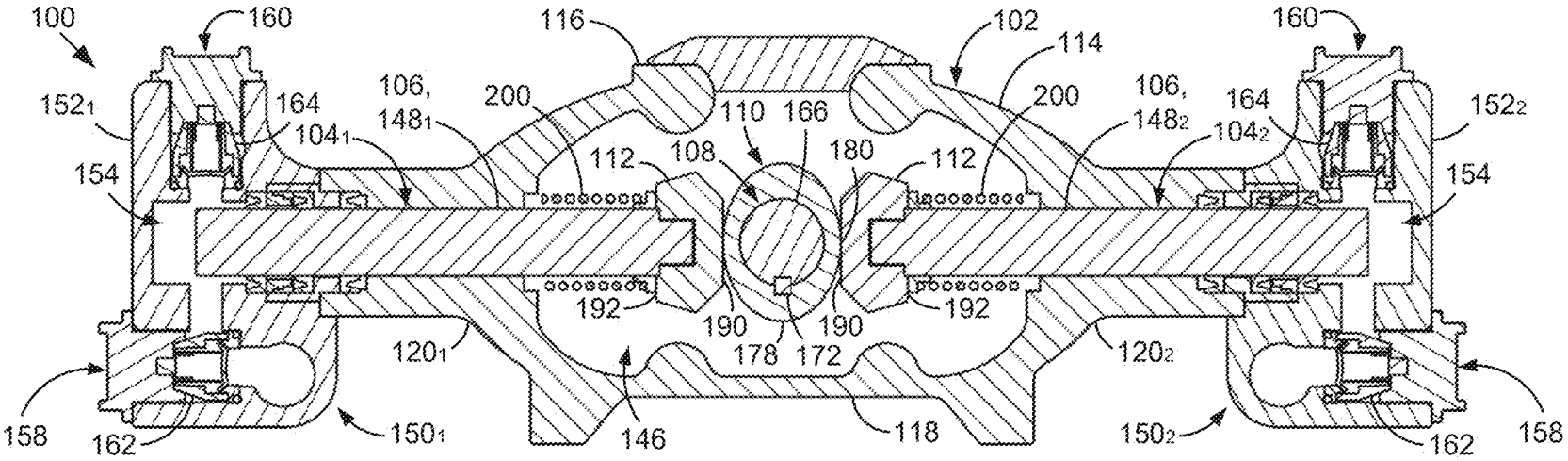
FIG. 18A is a side cross-sectional view taken along line 18-18 in FIG. 17 with the first and second pumping chambers and a pair of pistons in the heel position with an ellipsoid cam.
Figure 18B:
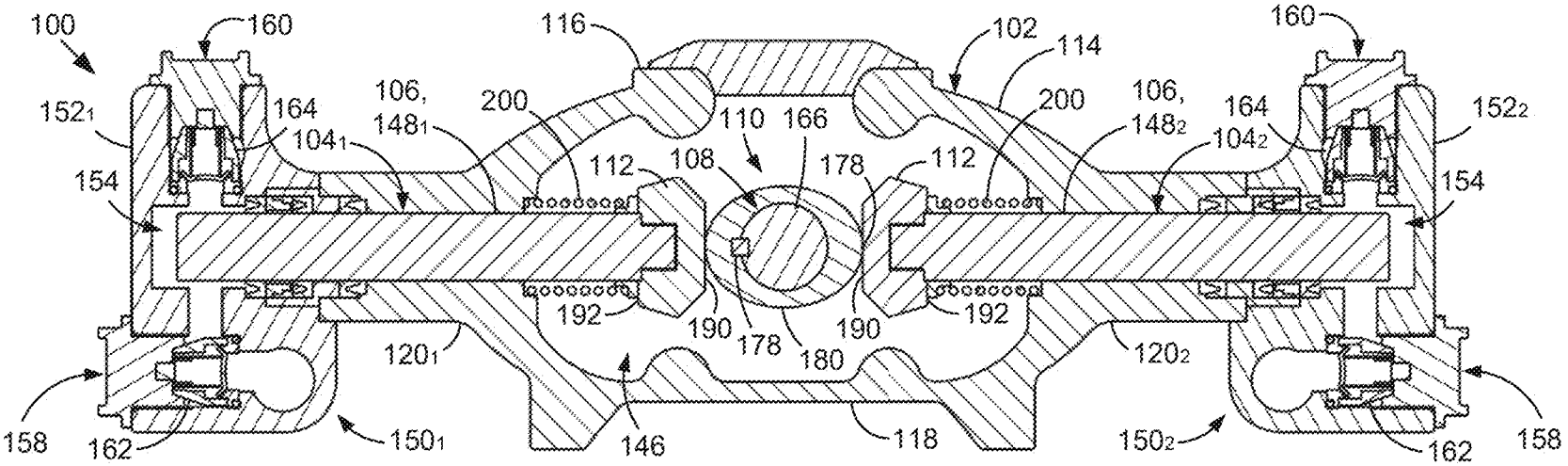
FIG. 18B is a side cross-sectional view taken along line 18-18 in FIG. 17 with the first and second pumping chambers and the pair of pistons in the nose position with the ellipsoid cam.

The pumping volume of the piston pump 100 may also be adjusted by increasing the number of pumping chambers 150 (and corresponding components, including pistons 104, cams 110, working chambers 154, etc.). For example, as shown in FIGS. 17 to 18, the pumping chamber 150 may be a first pumping chamber $150_1$, and the pump housing 102 may further include a second pumping chamber $150_2$. The second pumping chamber $150_2$ may be positioned opposite the first pumping chamber $150_1$ and may have substantially the same configuration as described previously with respect to the first pumping chamber $150_1$, which is not repeated herein for brevity. Accordingly, in such examples, the rear wall 120 having the plurality of piston passages 148 may be a first rear wall $120_1$ having a first plurality of piston passages $148_1$, and the pump housing 102 may further include a second rear wall $120_2$ (in place of the front wall 142) having a second plurality of piston passages $148_2$ extending from the crankshaft chamber 146 to the second pumping chamber $150_2$. Similarly, the plurality of pistons 104 may be a first plurality of pistons $104_1$, and the piston pump 100 may further include a second plurality of pistons $104_2$ slidably mounted in the second plurality of piston passages $148_2$. As shown, each cam 110 may correspond to a first piston $104_1$ of the first plurality of pistons and to a second piston $104_2$ of the second plurality of pistons. In this way, rotation of the crankshaft 108 may cause both the first and second pistons 104 to alternate between the nose position and the heel position. Accordingly, the pumping volume of the piston pump 100 may be doubled. It will be appreciated that the pumping volume of the piston pump 100 may further be tripled, quadrupled, or more, by increasing the number of pumping chambers 150 circumferentially spaced about the crankshaft 108 such that the number of pistons 104 driven by each cam 110 may be similarly increased.

A piston pump 100 in accordance with this disclosure may have a pump strength coefficient of at least 300 bar·L/min. As used herein and in the claims, the pump strength coefficient may be understood as the pump pressure (bar) multiplied by the pump volume (L/min). Any pump volume at any pump pressure may be possible to achieve a pump strength coefficient of at least 300 bar·L/min. For example, the pump strength coefficient of the piston pump 100 may be at least 300 bar·L/min at a pump pressure of 100 bar and a pump volume of at least 3 L/min, at a pump pressure of 50 bar and a pump volume of at least 6 L/min, or at a pump pressure of 25 bar and a pump volume of at least 12 L/min. Conversely, as another example, the pump strength coefficient of the piston pump 100 may be at least 300 bar·L/min at a pump pressure of at least 100 bar and a pump volume of 3 L/min, at a pump pressure of at least 50 bar and a pump volume of 6 L/min, or at a pump pressure of at least 25 bar and a pump volume of 12 L/min. That is, a pump strength coefficient of at least 300 bar·L/min may be achieved by varying the pump volume, the pump pressure, or both.

In accordance with another aspect of this disclosure, any of the pump housing 102, the pistons 104, and the crankshaft 108, may be, in whole or in part, extrusion-formed. Accordingly, the piston pump 100 may similarly be, in whole or in part, extrusion-formed. As used herein and in the claims, a component may be said to be extrusion-formed where at least one subcomponent thereof is manufactured by extrusion. For example, the pump housing 102 may be considered extrusion-formed where the manufacture of one or more of the pump main body 114, the sidewalls 126, the front wall 142, and the pumping chamber housing 152 includes an extrusion step. As another example, the pistons 104 may be considered extrusion formed where the manufacture of one or both of the piston shaft 106 and the crown 112 includes an extrusion step. As another example, the crankshaft 108 may be considered extrusion formed where the manufacture of one or both of the crankshaft axle 166 and the cams 110 includes an extrusion step.

Further, a subcomponent may be said to be extrusion formed where its manufacture includes an extrusion step (and optionally a segmenting step including segmenting an extruded profile into two or more discrete subcomponents of the same type) and a majority (i.e., more than 50%) of a mass of the subcomponent after the extrusion step (and optional segmenting step) is retained after subsequent manufacturing steps (e.g., machining features such as flanges, bores, passages, recesses, and the like). Accordingly, any of the pump main body 114, sidewalls 126, front wall 142, crankshaft axle 166, cams 110, piston shafts 106, and piston crowns 112 may be considered extrusion-formed. For example, the pump main body 114 may be considered extrusion-formed where more than 50% of a mass of the pump main body 114 after the extrusion step (and optional segmenting step) is retained after subsequently machining in the plurality of piston passages 148 and other features. As another example, each sidewall 126 may be considered extrusion-formed where more than 50% of a mass of the sidewall 126 after the extrusion step (and optional segmenting step) is retained after subsequently machining in the central protruding portion 128 and flange 130, crankshaft passage 134, optional bearing recess 130, and other features. As another example, the cams 110 may be considered extrusion-formed where more than 50% of a mass of each cam 110 after the extrusion step (and optional segmenting step) is retained after subsequently machining in the central axle opening 170 and optional cam lock recess 174.

Manufacture by extrusion may confer any of the benefits described previously, including reducing costs of manufacture (e.g., by accelerating production time, increasing production volume, and minimizing material waste) and reducing ecological impact, while producing high-strength, simple to assemble piston pumps, suitable for pumping fluids at high pressures. Further, as described previously, the material properties of extruded material (e.g., cam material of cams 110, crown material of piston crowns 112) can be precisely and repeatably controlled, calculated, and programmed. In this way, the piston crowns 112 may be designed to wear in favor of the cams 110, and the rate of wear may be relatively even among the piston crowns 112 and at predetermined rate such that maintenance (e.g., replacement) of the piston crowns 112 may be on a predetermined schedule.

As used herein and in the claims, a precursor of a component may be understood as having the bulk shape/profile of the component. The precursor may have a precursor length at least the length of one such component. Optionally the precursor length may be at least the length of two or more such components. In such embodiments, the precursor may be segmented (e.g., cut, sawn, etc.) into two or more such discrete components. The precursor may be in the absence of various features such as flanges, bores, passages, recesses, and the like. In some embodiments, such features may be produced by subsequent manufacturing steps, such as machining (e.g., turning, drilling, milling, grinding, planing, and the like).

Figure 19A:
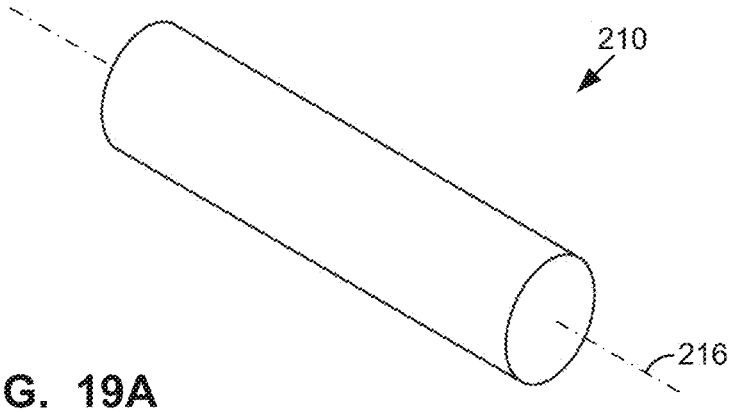
FIG. 19A is a perspective view of a cam precursor.
Figure 19B:
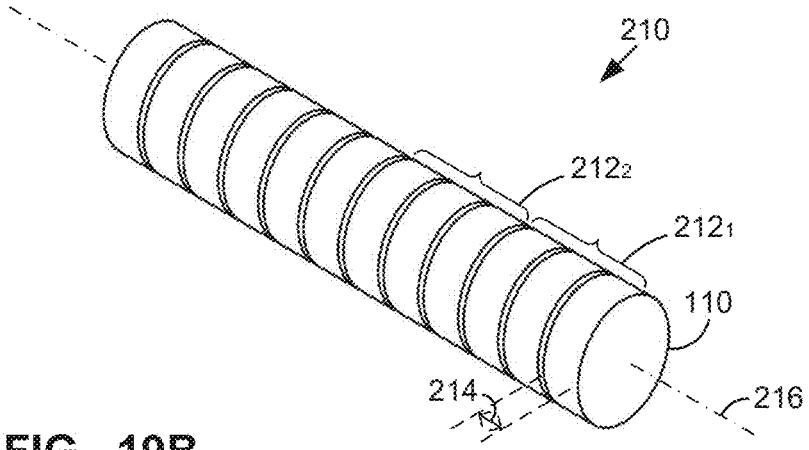
FIG. 19B is a perspective view of the cam precursor after segmenting into a plurality of cams.
Figure 19C:
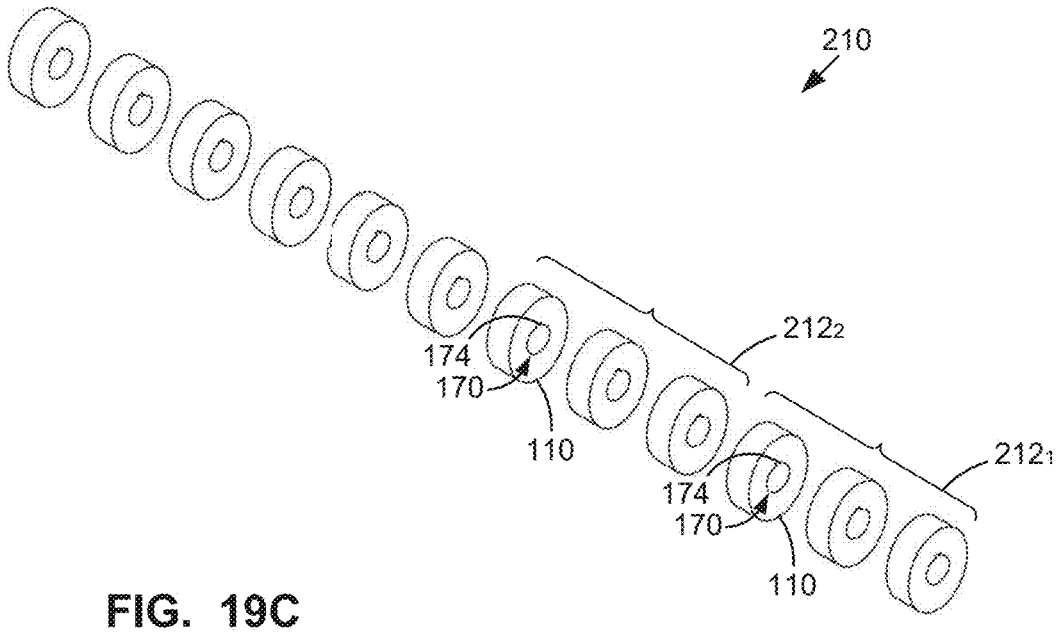
FIG. 19C is a perspective view of the plurality of cams after machining.
Figure 20A:
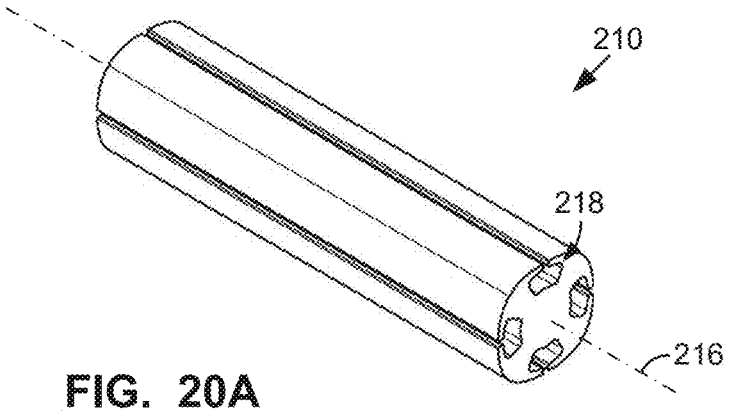
FIG. 20A is a perspective view of a cam precursor having a plurality of hollow cores.
Figure 20D:
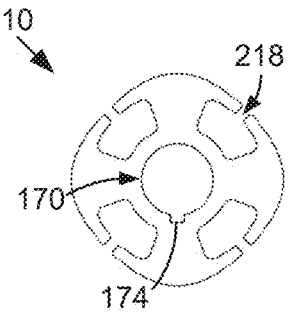
FIG. 20D is a front view of one of the cams after machining.
Figure 20B:
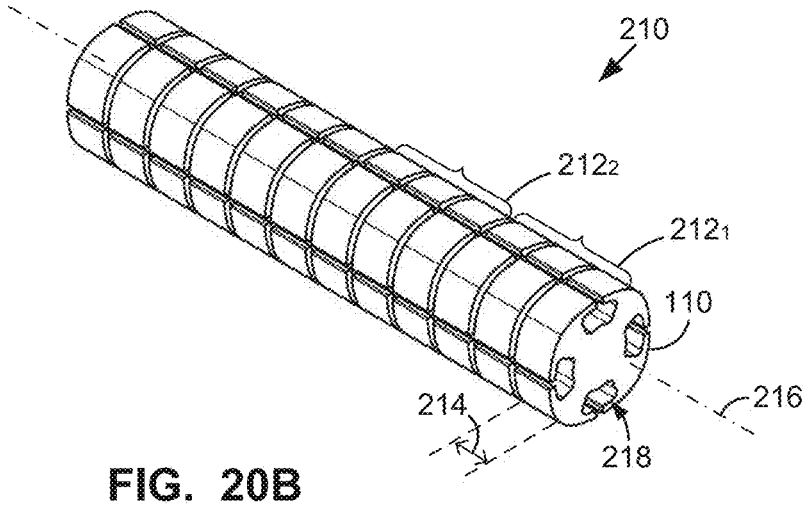
FIG. 20B is a perspective view of the cam precursor after segmenting into a plurality of cams.

Referring now to FIGS. 19 and 20, a method of mass-producing crankshafts 108 includes extruding a cam precursor 210 as an elongated non-circular rod (see e.g., FIGS. 19A and 20A). The cam precursor 210 may be extruded from any metal or metal alloy as described previously herein with respect to the cams 110. Optionally after extruding the cam precursor 210, the method may include applying an abrasion-resistance treatment to a surface of the metal alloy of the cam precursor.

The method of mass-producing crankshafts 108 may further include segmenting the cam precursor 210 (see e.g., FIGS. 19B and 20B) into a first plurality of cams $\mathbf{212}_1$ and a second plurality of cams $\mathbf{212}_2$, each of the cams 110 in the first and second plurality of cams 210 having a cam width 214. As shown, segmenting the cam precursor 212 may include cutting the cam precursor 212 in a direction transverse to a longitudinally extending cam precursor axis 216 at a regular interval along the cam precursor axis 216, where the regular interval is the cam width 214.

Optionally, as shown in FIGS. 20A to 20D, the cam precursor 210 may be extruded with a plurality of hollow cores 218 spaced circumferentially about the longitudinally extending cam precursor axis 216 such that, after segmenting the cam precursor 210, each of the cams 110 in the first and second plurality of cams 212 have the plurality of hollow cores 218. The hollow cores 218 may advantageously reduce inertia of the cams 110 and reduce material used in manufacturing, thereby reducing costs.

Figure 20C:
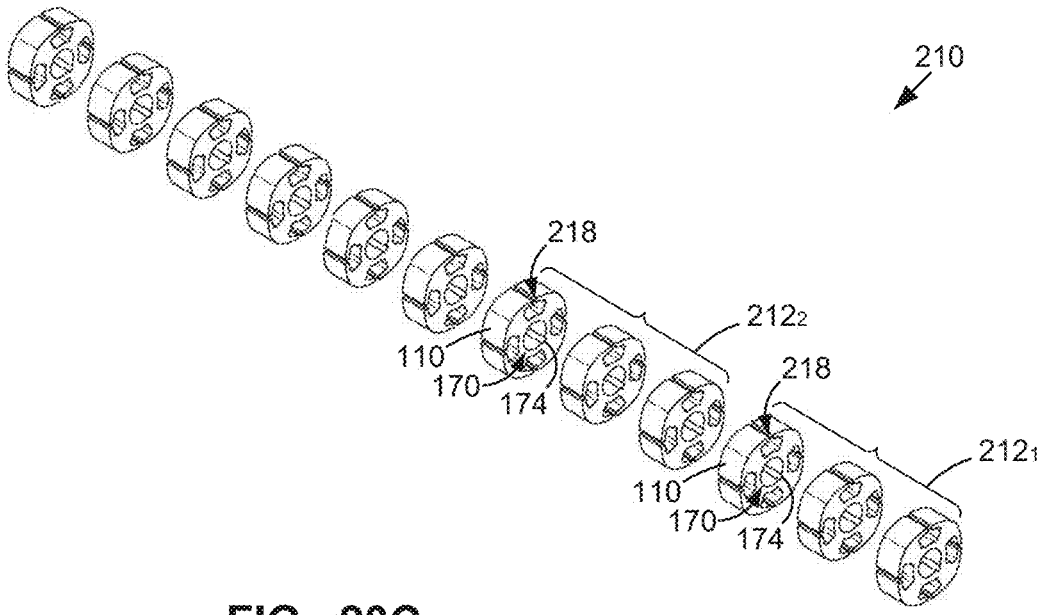
FIG. 20C is a perspective view of the plurality of cams after machining.

The method of mass-producing crankshafts 108 may further include machining the central axle opening 170 through each cam 110 of the first and second plurality of cams 212 (see e.g., FIGS. 19C and 20C). Optionally, the cam precursor 210 may be extruded with the central axle opening 170 such that, after segmenting the cam precursor 210, each of the cams 110 in the first and second plurality of cams 212 have the central axle opening 170.

The method of mass-producing crankshafts 108 may further include segmenting a crankshaft axle precursor formed as an elongated circular rod into a first crankshaft axle and a second crankshaft axle, where each of the first and second crankshaft axles have an axle length. The crankshaft axle precursor may be an existing elongated circular rod of stock material or, optionally, the method may include extruding the crankshaft axle precursor as the elongated circular rod before segmenting. The stock material of crankshaft axle precursor may be, or the crankshaft axle precursor may be extruded from, any metal or metal alloy as described previously herein with respect to the crankshaft axle 166. Segmenting the crankshaft axle precursor may include cutting the crankshaft axle precursor in a direction transverse to a longitudinally extending crankshaft axle precursor axis at a regular interval along the crankshaft axle precursor axis, where the regular interval is the axle length.

The method of mass-producing crankshafts 108 may further include mounting the first plurality of cams $\mathbf{212}_1$ onto the first crankshaft axle and mounting the second plurality of cams $\mathbf{212}_2$ onto the second crankshaft axle. As exemplified in FIG. 10B, mounting the cams 110 of the first and second plurality of cams 212 to the first and second crankshaft axles may include inserting the respective crankshaft axle into the central axle opening 170 of the cams 110 of the first and second plurality of cams 212.

The method of mass-producing crankshafts 108 may further include rigidly connecting the first plurality of cams $\mathbf{212}_1$ to the first crankshaft axle along the axle length thereof, and the second plurality of cams $\mathbf{212}_2$ to the second crankshaft axle along the axle length thereof. Rigidly connecting the cams 110 to their respective crankshaft axles may be done by any means described previously herein. Optionally, as described previously with respect to FIGS. 10A to 10C and FIGS. 11 to 12, the central axle opening 170 (whether machined or extruded) of each of the cams 110 in the first and second plurality of cams 212 may have the cam lock recess 174. In such examples, the method may further include securing a first plurality of cam securement pins 172 to the first crankshaft axle, and securing a second plurality of cam securement pins 172 to the second crankshaft axle, and rigidly connecting the first and second plurality of cams 212 to the first and second crankshafts may include, for each cam 110, slidably mating the cam lock recess 174 with a corresponding one of the cam securement pins 172 of the respective crankshaft axle.

A method of mass-producing pistons 104 includes segmenting a piston shaft precursor formed as an elongated rod into a first piston shaft and a second piston shaft, each of the first and second piston shafts having a shaft length extending from a first shaft end to a second shaft end. Segmenting the piston shaft precursor may include cutting the piston shaft precursor in a direction transverse to a longitudinally extending piston shaft precursor axis at a regular interval along the piston shaft precursor axis, where the regular interval is the shaft length.

The piston shaft precursor may be an existing elongated rod of stock material or, optionally, the method may include extruding the piston shaft precursor as the elongated rod before segmenting. The stock material of piston shaft precursor may be, or the piston shaft precursor may be extruded from, any metal or metal alloy as described previously herein with respect to the piston shaft 106.

The method of mass-producing pistons 104 may further include applying an abrasion-resistance treatment to a surface of the first and second piston shafts for at least a portion of the shaft length thereof. Optionally, the abrasion-resistance treatment may be applied to the piston shaft precursor before segmenting.

Figure 21A:
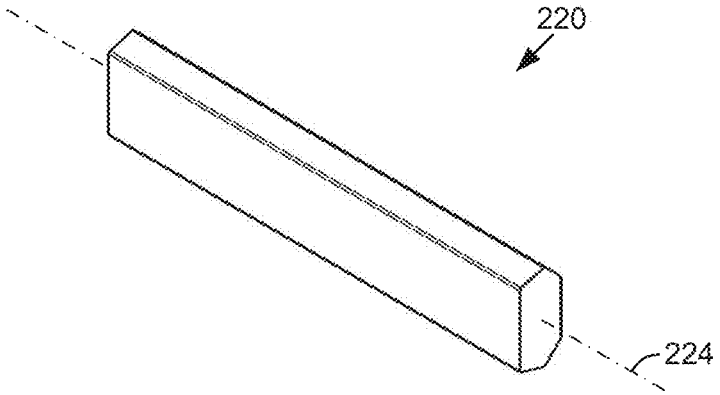
FIG. 21A is a perspective view of a piston crown precursor.
Figure 21B:
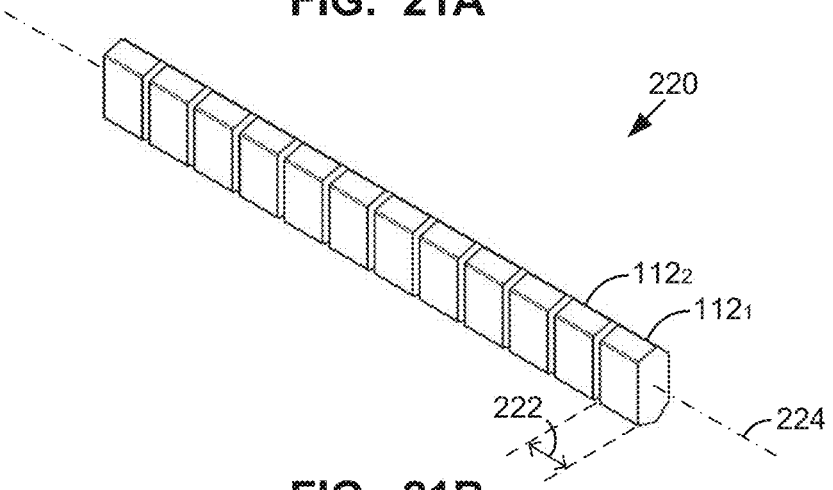
FIG. 21B is a perspective view of the piston crown precursor after segmenting into a plurality of piston crowns.
Figure 21C:
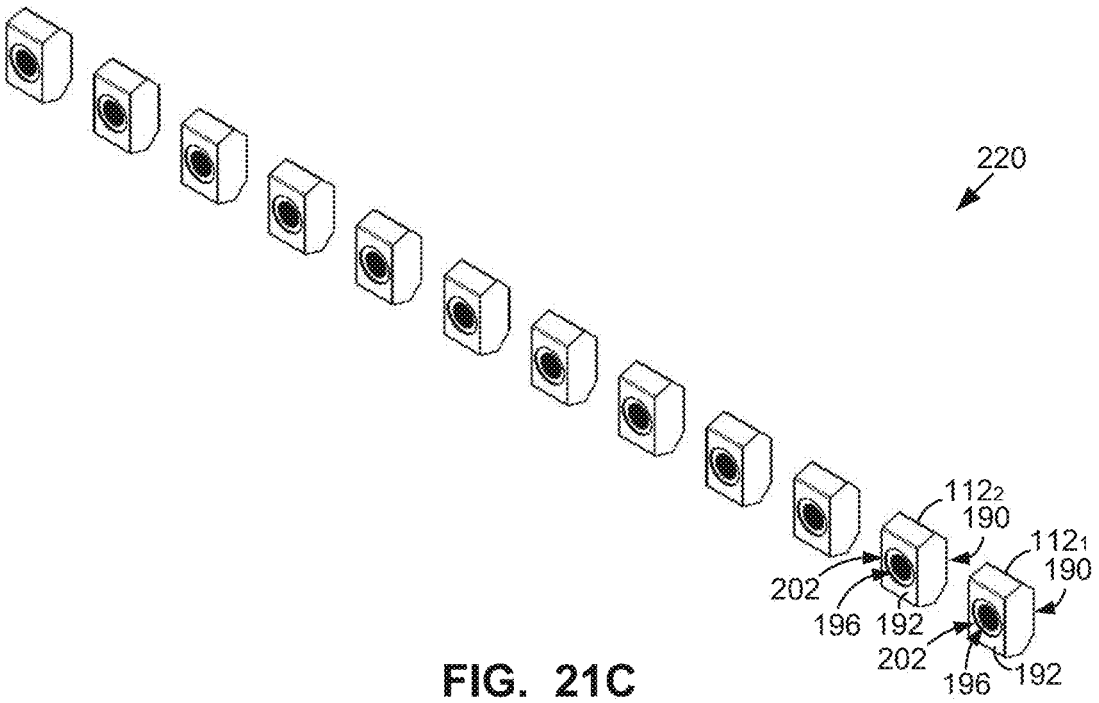
FIG. 21C is a perspective view of the plurality of piston crowns after machining.

Referring now to FIGS. 21A to 21C, the method of mass-producing pistons 104 may further include extruding a piston crown precursor 220 formed as an elongated profile having the cam engagement side and the opposed shaft engagement side. The cam engagement side may optionally be flat or concave. The piston crown precursor 220 may be extruded from any metal or metal alloy as described previously herein with respect to the piston crown 112.

The method of mass-producing pistons 104 may further include segmenting the piston crown precursor 220 into a first piston crown $\mathbf{112}_1$ and a second piston crown $\mathbf{112}_2$, each of the first and second piston crowns 112 having the cam engagement side 190, the shaft engagement side 192, and a crown width 222. As shown, segmenting the piston crown precursor 220 includes cutting the piston crown precursor 212 in a direction transverse to a longitudinally extending piston crown precursor axis 224 at a regular interval along the piston crown precursor axis 224, where the regular interval is the crown width 222.

The method of mass-producing pistons 104 may further include connecting the shaft engagement side 192 of the first and second piston crowns 112 to the first shaft end $\mathbf{186}_1$ of the first and second piston shafts. Connecting the piston crowns 112 to their respective piston shafts may be done by any means described previously herein. Optionally, as described previously with respect to FIGS. 13 to 15, connecting may include threadably connecting. In such examples, the method may include forming a threaded portion of the first and second piston shafts by machining an external thread into the first and second piston shafts from the first shaft end $\mathbf{186}_1$ toward the second shaft end $\mathbf{186}_2$, drilling an internally threaded bore 196 into the shaft engagement side 192 of the first and second piston crowns 112, and threadably connecting the internally threaded bore 196 of the first and second piston crowns 112 to the threaded portion of the first and second piston shafts.

Optionally, the method may further include machining a bias seat 202 into the shaft engagement side 192 of the first and second piston crowns 112 around the internally threaded bores 196 thereof.

A method of mass-producing piston pumps includes the method of mass-producing crankshafts as described herein, the method of mass-producing pistons as described herein to produce a first plurality of pistons and a second plurality of pistons, and mass-producing pump housings.

Figure 22A:
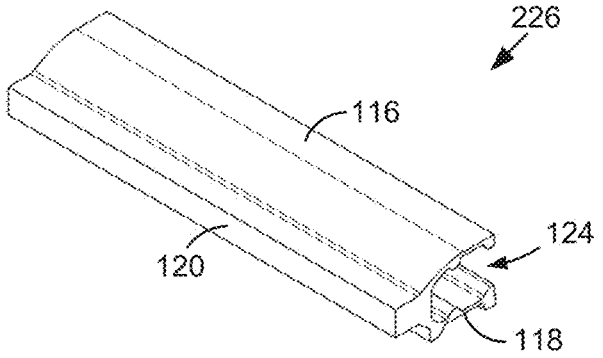
FIG. 22A is a perspective view of a pump main body precursor with a front opening.
Figure 22B:
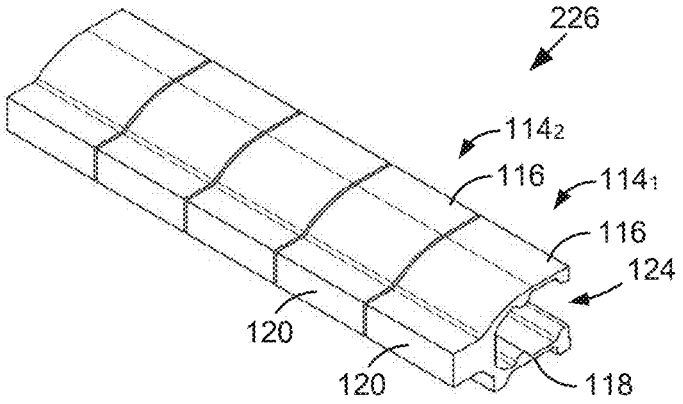
FIG. 22B is a perspective view of the pump main body precursor after segmenting into a plurality of pump main bodies having the front opening.
Figure 22C:
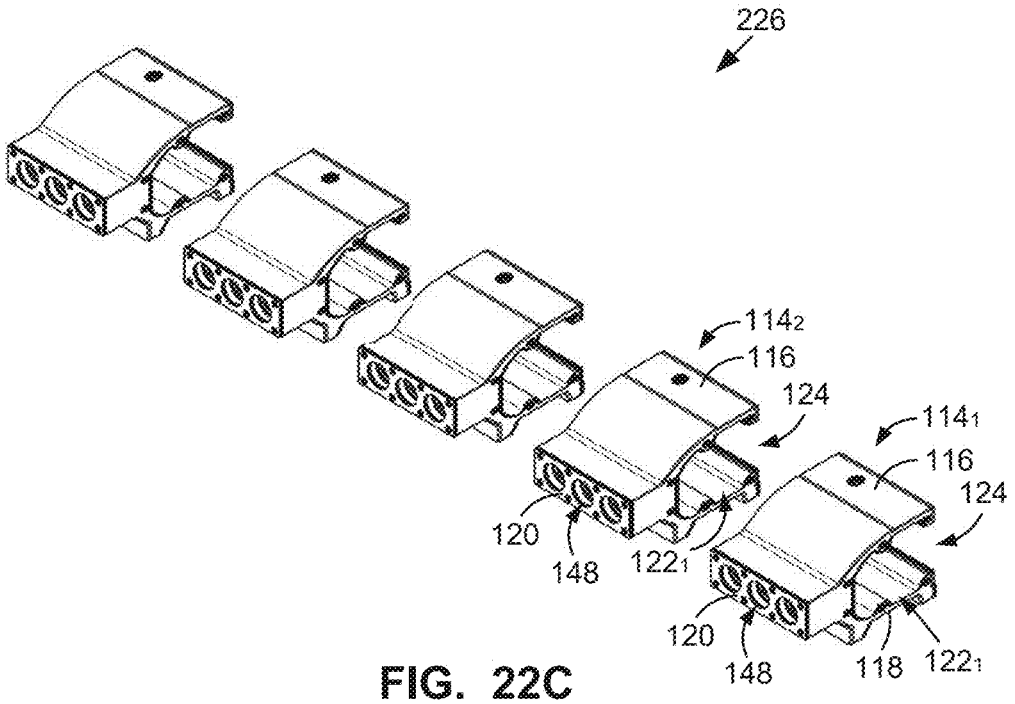
FIG. 22C is a perspective view of the plurality of pump main bodies having the front opening after machining.
Figure 23A:
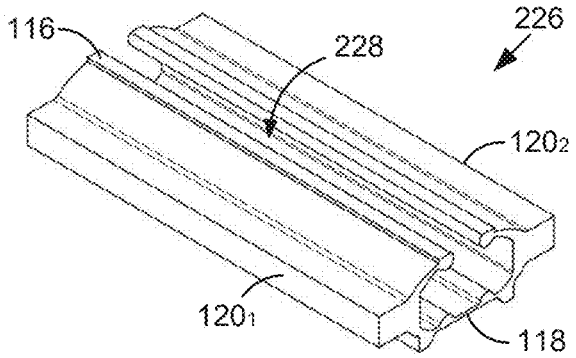
FIG. 23A is a perspective view of a pump main body precursor with a top opening.
Figure 23B:
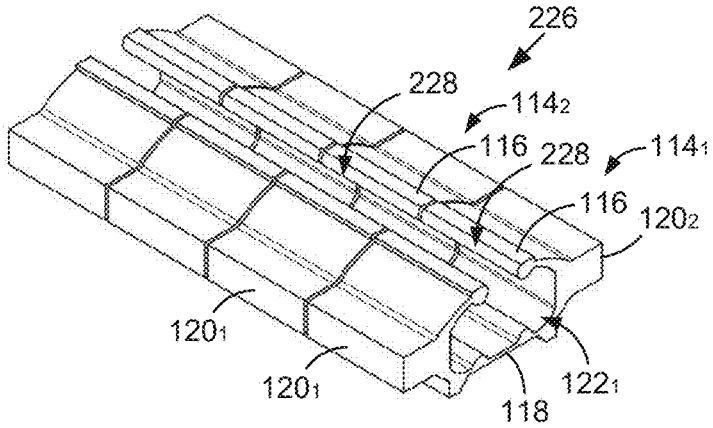
FIG. 23B is a perspective view of the main body precursor after segmenting into a plurality of pump main bodies having the top opening.
Figure 23C:
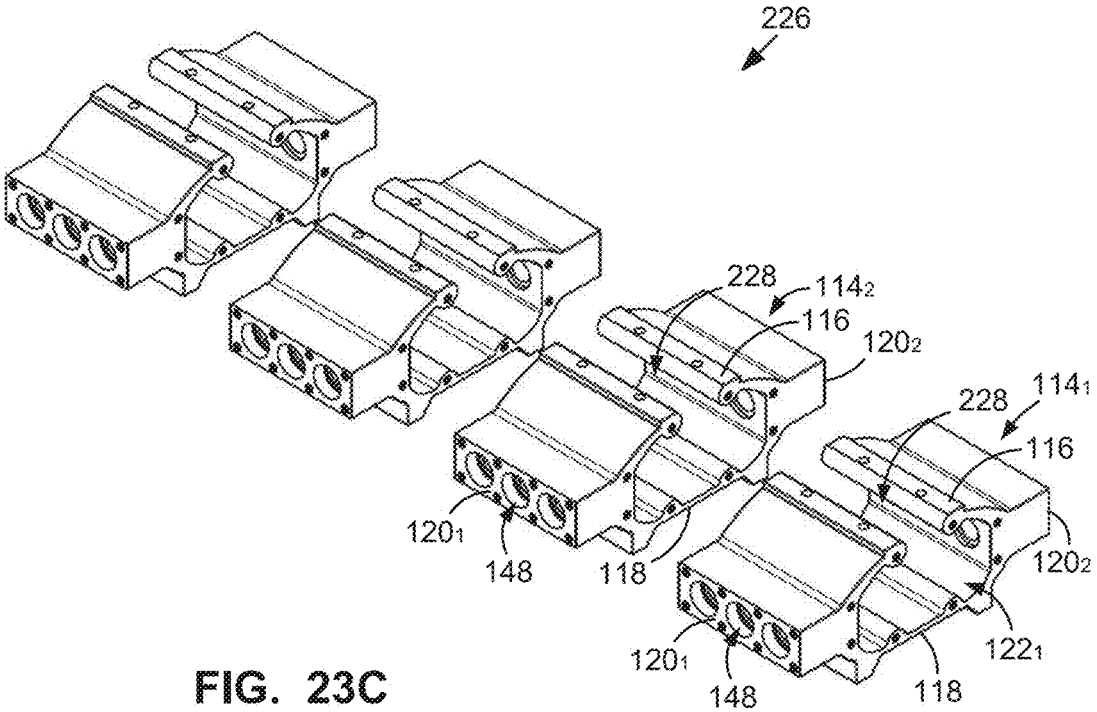
FIG. 23C is a perspective view of the plurality of dual pump main bodies having the top opening after machining.

Referring to FIGS. 22 and 23, mass-producing pump housings includes extruding a pump main body precursor 226 formed as an elongated profile having the top wall 116 and bottom wall 118. Where the piston pump being mass-produced is for use with a single pumping chamber, the pump main body precursor 226 may have the rear wall 120 extending between the top and bottom walls 116, 118 and the front opening 124 (see e.g., FIG. 22A). Alternately, where the piston pump being mass-produced is for use with two opposed pumping chambers, the pump main body precursor 226 may have the first rear wall $\mathbf{120}_1$ and the second rear wall $\mathbf{120}_2$ extending between the top and bottom walls 116, 118 (see e.g., FIG. 23A).

Mass-producing pump housings may further include segmenting the pump main body precursor 226 into a first pump main body $\mathbf{114}_1$ and a second pump main body $\mathbf{114}_2$, each of the first and second pump main bodies 114 having the top wall 116, bottom wall 118, rear wall(s) 120, the first side opening $\mathbf{122}_1$, and the second side opening $\mathbf{122}_2$. Where the piston pump being mass-produced is for use with a single pumping chamber, the first and second pump main bodies 114 may also have the front opening 124 (see e.g., FIG. 22B). Alternately, where the piston pump being mass-produced is for use with two opposed pumping chambers, the first and second pump main bodies 114 may have a top opening 228 (see e.g., FIG. 23B).

Mass-producing pump housings may further include machining (e.g., drilling) the plurality of piston passages 148 through the rear wall(s) 120 of the first and second pump main bodies 114.

Figure 24A:
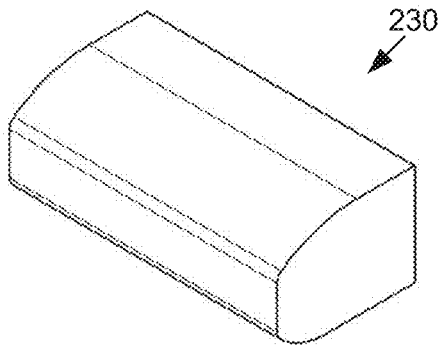
FIG. 24A is a perspective view of a pump sidewall precursor.
Figure 24B:
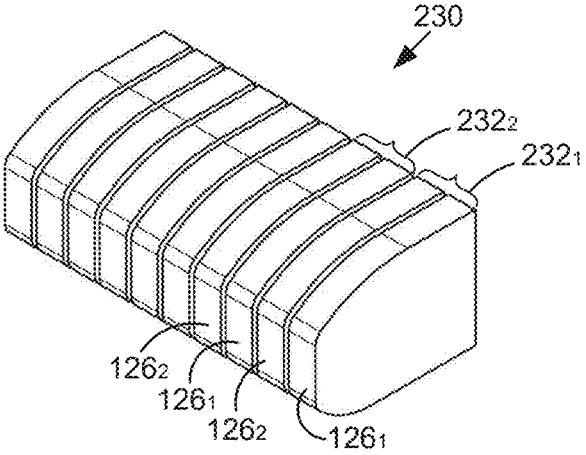
FIG. 24B is a perspective view of the pump sidewall precursor after segmenting into a plurality of pump sidewalls.
Figure 24C:
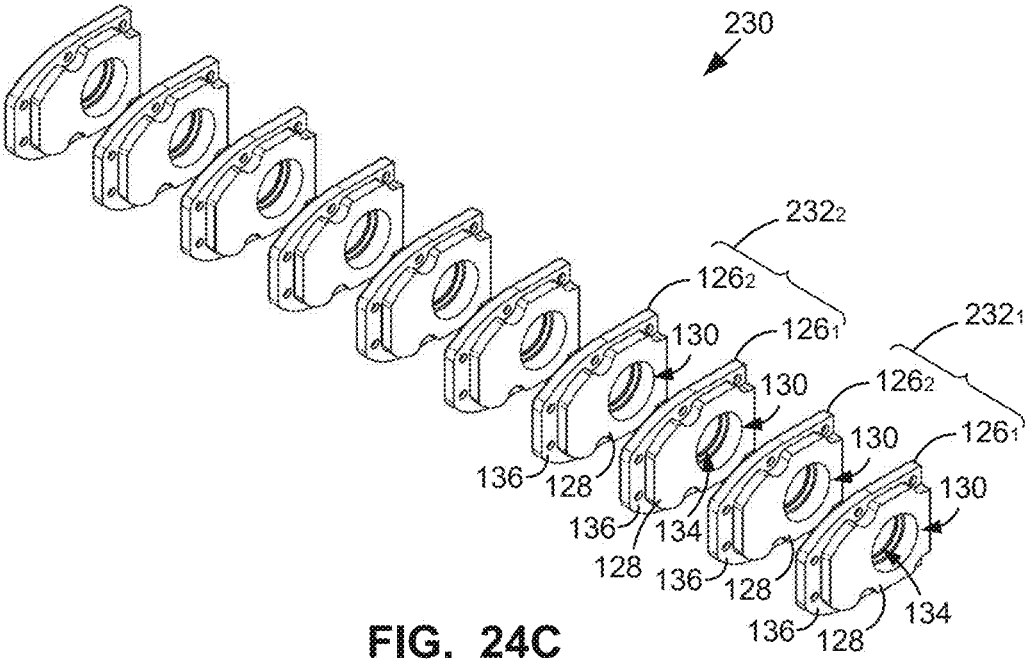
FIG. 24C is a perspective view of the plurality of pump sidewalls after machining.

Referring to FIGS. 24A to 24C, mass-producing pump housings may further include extruding a pump sidewall precursor 230 formed as an elongated profile shaped to match the side cross-sectional shape of the pump main body precursor 226 and segmenting the pump sidewall precursor 230 into a first pair of sidewalls $232_1$ and a second pair of sidewalls $232_2$, each pair of sidewalls 232 having the first sidewall $126_1$ and the second sidewall $126_2$.

Mass-producing pump housings may further include machining (e.g., drilling) the first and second sidewalls 126 of the first and second pair of sidewalls 232 about a perimeter of each sidewall to produce the central protruding portion 128 bordered by the flange 136 and further machining the central protruding portion 128 to include the bearing recess 130 and, for at least one of the first and second sidewalls 126, the crankshaft passage 134.

It will be appreciated that mass-producing pump housings may further include extruding a front wall precursor, segmenting the front wall precursor into a first and second front wall for enclosing the front opening 124 of the first and second pump main bodies 114 of FIGS. 22A to 22C, and optionally machining the first and second front walls, in a similar manner to that described with respect to the sidewalls 126. It will similarly be appreciated that mass-producing pump housings may further include extruding a top wall precursor, segmenting the top wall precursor into a first and second top wall for enclosing the top opening 228 of the first and second pump main bodies 114 of FIGS. 23A to 23C, and optionally machining the first and second top walls, in a similar manner to that described with respect to the sidewalls 126.

The method of mass-producing piston pumps includes assembling a first piston pump. Assembling the first piston pump may include slidably mounting each piston 104 of the first plurality of pistons into a corresponding piston passage 148 of the plurality of piston passages of the first pump main body $114_1$, inserting bearings 132 into the bearing recesses 130 of the first and second sidewalls 126 of the first pair of sidewalls $232_1$, connecting the first and second sidewalls 126 of the first pair of sidewalls $232_1$ to the first pump main body $114_1$ by inserting the central protruding portion of the first and second sidewalls 126 into the first and second side openings 122 of the first pump main body $114_1$ and connecting the flange 136 of the first and second sidewalls 126 to the first pump main body $114_1$, rotatably mounting the first crankshaft axle between the first and second sidewalls 126, engaging (e.g., by resiliently biasing) the piston crown 112 of each piston 104 of the first plurality of pistons with a corresponding cam 110 of the first plurality of cams 110 of the first crankshaft, and enclosing the front opening 124 or top opening 228 using the first front wall or first top wall.

The method of mass-producing piston pumps may further include assembling a second piston pump by repeating assembly steps of the first piston pump using the second plurality of pistons, the second pump main body $114_2$, the first and second sidewalls 126 of the second pair of sidewalls $232_2$, the second crankshaft axle, and the second front wall or second top wall.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

ITEMS

Item 1. A piston pump comprising:
- a pump housing having
  - a crankshaft chamber,
  - a pumping chamber, and
  - a plurality of piston passages, the piston passages extending from the crankshaft chamber to the pumping chamber;
- a crankshaft rotatably mounted in the crankshaft chamber, the crankshaft having
  - a longitudinally extending crankshaft rotation axis, and
  - a plurality of cams distributed along the crankshaft axis, each cam having
    - a plurality of cam noses and a plurality of cam heels, the cam noses circumferentially alternating with the cam heels around the crankshaft axis, the cam noses all having a nose radius, the cam heels all having a heel radius, the nose radius being greater than the heel radius,
    - a cam stroke length that is a difference between the nose radius and the heel radius, and
    - a cam material abrasion resistance;
- a plurality of pistons, each piston corresponding to a cam of the plurality of cams, each piston slidably mounted in a corresponding piston passage of the plurality of piston passages between a nose position and a heel position, each piston having
  - a piston shaft extending within the corresponding piston passage, the piston shaft having a first shaft end positioned in the crankshaft chamber and a second shaft end, and
  - a sacrificial piston crown removably connected to the first shaft end, the piston crown having a cam engagement side in contact with the corresponding cam, the cam engagement side having a piston crown material abrasion resistance that is less than the cam material abrasion resistance; and
- a plurality of resiliently compressible piston biases, each piston bias biasing a corresponding piston of the plurality of pistons toward the crankshaft and maintaining constant contact between the cam engagement side of the piston crown and the corresponding cam of the piston as the crankshaft rotates, the piston being in the nose position when the cam engagement side is in contact with the nose of the cam, and the piston being in the heel position when the cam engagement side is in contact with the heel of the cam.

Item 2. The piston pump of any preceding item wherein each piston performs a first stroke when the piston moves from the heel position to the nose position and performs a second stroke when the piston moves from the nose position to the heel position, and each piston is driven by the corresponding cam to perform at least four strokes for each revolution of the crankshaft.

Item 3. The piston pump of any preceding item wherein each cam has a different angular orientation than at least one other cam of the plurality of cams.

Item 4. The piston pump of any preceding item wherein each cam heel of each cam is flat or convex.

Item 5. The piston pump of any preceding item wherein each cam has a cam convexity characteristic of greater than 1 and less than 1.5.

Item 6. The piston of any preceding item, wherein each piston has a convexity-size attribute greater than 3 mm.

Item 7. The piston pump of any preceding item wherein the crankshaft comprises a crankshaft axle, and the plurality of cams are removably connected to the crankshaft axle.

Item 8. The piston pump of any preceding item wherein each cam is inhibited from rotating relative to the crankshaft about the crankshaft axis when connected to the crankshaft.

Item 9. The piston pump of any preceding item wherein crankshaft comprises a crankshaft axle, each cam further has a central opening sized to receive the crankshaft axle, and each cam is slidably removably connected to the crankshaft axle through the central opening.

Item 10. The piston pump of any preceding item wherein:

the crankshaft further comprises a plurality of cam securement pins distributed along the crankshaft axis and extending radially outwardly from the crankshaft axle, and the central opening of each cam has a cam lock recess mated with a corresponding one of the plurality of cam securement pins.

Item 11. The piston pump of any preceding item wherein each cam securement pin inhibits the mating cam from rotating relative to the crankshaft axle about the crankshaft axis.

Item 12. The piston pump of any preceding item wherein each cam securement pin has a different angular orientation than at least one other cam securement pin.

Item 13. The piston pump of any preceding item wherein each cam securement pin extends radially outwardly from the crankshaft axle at the same angular orientation.

Item 14. The piston pump of any preceding item wherein each piston bias is positioned around the piston shaft of the corresponding piston between the piston crown and the corresponding piston passage.

Item 15. The piston pump of any preceding item wherein each piston crown is rigidly connected to the piston shaft when connected to the first shaft end.

Item 16. The piston pump of any preceding item wherein the crankshaft chamber contains a lubricating oil, the lubricating oil having a surface level at an elevation between the crankshaft axle and the heel of one of the cams when that heel is oriented downwards below the crankshaft axle.

Item 17. The piston pump of any preceding item further comprising a plurality of linear bearings, each linear bearing slidably mounting a corresponding piston of the plurality of pistons in the corresponding piston passage.

Item 18. The piston pump of any preceding item wherein:

the pumping chamber is a first pumping chamber, the pump housing further comprises a second pumping chamber, the plurality of piston passages is a first plurality of piston passages, the pump housing further comprises a second plurality of piston passages extending from the crankshaft chamber to the second pumping chamber, the plurality of pistons is a first plurality of pistons, the piston pump further comprises a second plurality of pistons, each piston of the second plurality of pistons slidably mounted in a corresponding piston passage of the second plurality of piston passages, and each cam corresponds to a first piston of the first plurality of pistons and to a second piston of the second plurality of pistons.

Item 19. The piston pump of any preceding item wherein the piston pump has a pumping volume of at least 4 L/min at least at 25 bar when the crankshaft is rotated at 20,000 rpm or less.

Item 20. The piston pump of any preceding item wherein the piston pump has a pump strength coefficient of at least 300 bar·L/min.

Item 21. The piston pump of any preceding item wherein the piston shaft has a unitary construction of solid metal and an exterior surface, at least a portion of the exterior surface having an abrasion-resistance surface treatment.

Item 22. The piston pump of any preceding item wherein the pump housing and each cam of the plurality of cams is extrusion-formed.

Item 23. A piston pump comprising:

a pump housing having a crankshaft chamber, a pumping chamber, and a plurality of piston passages, the piston passages extending from the crankshaft chamber to the pumping chamber;

a crankshaft rotatably mounted in the crankshaft chamber, the crankshaft having a longitudinally extending crankshaft rotation axis, and a plurality of cams distributed along the crankshaft axis;

a plurality of pistons, each piston corresponding to a cam of the plurality of cams, each piston slidably mounted in a corresponding piston passage of the plurality of piston passages between a nose position and a heel position, each piston having a piston shaft extending within the corresponding piston passage, the piston shaft having a first shaft end positioned in the crankshaft chamber and a second shaft end, the piston shaft having a unitary construction of solid metal and an exterior surface, at least a portion of the exterior surface having an abrasion-resistance surface treatment, and a piston crown connected to the first shaft end, the piston crown having a cam engagement side in contact with the corresponding cam; and a plurality of resiliently compressible piston biases, each piston bias biasing a corresponding piston of the plurality of pistons toward the crankshaft and maintaining constant contact between the cam engagement side of the piston crown and the corresponding cam of the piston as the crankshaft rotates.

Item 24. The piston pump of any preceding item wherein:

each piston passage comprises a piston seal, each piston extends through the piston seal of the corresponding piston passage, and for each piston, the piston seal is continually engaged with the portion of the exterior surface of the piston shaft having the abrasion-resistance surface treatment when the piston moves between the nose position and the heel position.

Item 25. The piston pump of any preceding item wherein each cam of the plurality of cams has a plurality of cam noses and a plurality of cam heels, the cam noses circumferentially alternating with the cam heels around the crankshaft axis, the cam noses all having a nose radius, the cam heels all having a heel radius, the nose radius being greater than the heel radius, wherein each piston is in the nose position when the cam engagement side of the piston crown is in contact with the nose of the corresponding cam of the piston, and each piston is in the heel position when the cam engagement side of the piston crown is in contact with the heel of the corresponding cam of the piston.

Item 26. The piston pump of any preceding item wherein:
each cam of the plurality of cams has a cam material abrasion resistance, and
the piston crown of each piston is a sacrificial piston crown having a piston crown material abrasion resistance, the piston crown material abrasion resistance being less than the cam material abrasion resistance.

Item 27. The piston pump of any preceding item wherein each piston crown is removably connected to the piston shaft when connected to the first shaft end.

Item 28. The piston pump of any preceding item wherein the cam engagement side of each piston crown is concave.

Item 29. The piston pump of any preceding item wherein each piston crown is rigidly connected to the piston shaft when connected to the first shaft end.

Item 30. The piston pump of any preceding item wherein each piston bias is positioned around the piston shaft of the corresponding piston between the piston crown and the corresponding piston passage.

Item 31. The piston pump of any preceding item wherein the crankshaft chamber contains a lubricating oil, the lubricating oil having a surface level at an elevation between the plurality of piston passages and the heel of one of the cams when that heel is oriented downwards.

Item 32. The piston pump of any preceding item further comprising a plurality of linear bearings, each linear bearing slidably mounting a corresponding piston of the plurality of pistons in the corresponding piston passage.

Item 33. The piston pump of any preceding item wherein the piston pump has a pumping volume of at least 4 L/min at least at 25 bar when the crankshaft is rotated at 20,000 rpm or less.

Item 34. The piston pump of any preceding item wherein the piston pump has a pump strength coefficient of at least 300 bar·L/min.

Item 35. The piston pump of any preceding item wherein:
the pumping chamber is a first pumping chamber,
the pump housing further comprises a second pumping chamber,
the plurality of piston passages is a first plurality of piston passages,
the pump housing further comprises a second plurality of piston passages extending from the crankshaft chamber to the second pumping chamber,
the plurality of pistons is a first plurality of pistons,
the piston pump further comprises a second plurality of pistons, each piston of the second plurality of pistons slidably mounted in a corresponding piston passage of the second plurality of piston passages, and
each cam corresponds to a first piston of the first plurality of pistons and to a second piston of the second plurality of pistons.

Item 36. A piston pump comprising:
an extrusion-formed pump housing having
a crankshaft chamber,
a pumping chamber, and
a plurality of piston passages, the piston passages extending from the crankshaft chamber to the pumping chamber;
an extrusion-formed crankshaft rotatably mounted in the crankshaft chamber, the crankshaft having
a longitudinally extending crankshaft rotation axis, and
a plurality of cams distributed along the crankshaft axis;
a plurality of pistons, each piston corresponding to a cam of the plurality of cams, each piston slidably mounted in a corresponding piston passage of the plurality of piston passages between a nose position and a heel position, each piston having
a piston shaft extending within the corresponding piston passage, the piston shaft having a first shaft end positioned in the crankshaft chamber and a second shaft end, and
a piston crown connected to the first shaft end, the piston crown having a cam engagement side in contact with the corresponding cam; and
a plurality of resiliently compressible piston biases, each piston bias biasing a corresponding piston of the plurality of pistons toward the crankshaft and maintaining constant contact between the cam engagement side of the piston and the corresponding cam of the piston as the crankshaft rotates.

Item 37. The piston pump of any preceding item wherein each piston of the plurality of pistons is extrusion-formed.

Item 38. The piston pump of any preceding item wherein each cam of the plurality of cams is extrusion-formed.

Item 39. The piston pump of any preceding item wherein each cam of the plurality of cams has a plurality of cam noses and a plurality of cam heels, the cam noses circumferentially alternating with the cam heels around the crankshaft axis, the cam noses all having a nose radius, the cam heels all having a heel radius, the nose radius being greater than the heel radius,
wherein each piston is in the nose position when the cam engagement side of the piston crown is in contact with the nose of the corresponding cam of the piston, and each piston is in the heel position when the cam engagement side of the piston crown is in contact with the heel of the corresponding cam of the piston.

Item 40. The piston pump of any preceding item wherein each cam of the plurality of cams has a cam material abrasion resistance and the piston crown of each piston is a sacrificial piston crown having a piston crown material abrasion resistance, the piston crown material abrasion resistance being less than the cam material abrasion resistance.

Item 41. The piston pump of any preceding item wherein the crankshaft comprises an extrusion-formed crankshaft axle, each cam of the plurality of cams is extrusion-formed, and the plurality of cams are removably connected to the crankshaft axle.

Item 42. The piston pump of any preceding item wherein the piston shaft of each piston is extrusion-formed, the piston crown of each piston is extrusion-formed, and the piston crown of each piston is removably connected to the first shaft end of the piston.

Item 43. The piston pump of any preceding item wherein:
the crankshaft comprises a crankshaft axle, the plurality of cams are removably connected to the crankshaft axle, and each cam of the plurality of cams is extrusion-formed from a cam material having a cam material abrasion resistance, and
the piston crown of each piston is extrusion-formed from a piston crown material having a piston crown material abrasion resistance, the piston crown material abrasion resistance being less than the cam material abrasion resistance.

Item 44. The piston pump of any preceding item wherein the cam engagement side of each piston crown is concave.

Item 45. The piston pump of any preceding item wherein each piston crown is rigidly connected to the piston shaft when connected to the first shaft end.

Item 46. The piston pump of any preceding item wherein each piston bias is positioned around the piston shaft of the corresponding piston between the piston crown and the corresponding piston passage.

Item 47. The piston pump of any preceding item wherein the piston pump has a pumping volume of at least 4 L/min at least at 25 bar when the crankshaft is rotated at 20,000 rpm or less.

Item 48. The piston pump of any preceding item wherein the piston pump has a pumping volume of at least 4 L/min at least at 25 bar when the crankshaft is rotated at 2,500 rpm or less.

Item 49. The piston pump of any preceding item wherein the piston pump has a pump strength coefficient of at least 300 bar·L/min.

Item 50. The piston pump of any preceding item wherein:

the pumping chamber is a first pumping chamber, the extrusion-formed pump housing further comprises a second pumping chamber, the plurality of piston passages is a first plurality of piston passages, the extrusion-formed pump housing further comprises a second plurality of piston passages extending from the crankshaft chamber to the second pumping chamber, the plurality of extrusion-formed pistons is a first plurality of extrusion-formed pistons, the piston pump further comprises a second plurality of extrusion-formed pistons, each piston of the second plurality of pistons slidably mounted in a corresponding piston passage of the second plurality of piston passages, and each cam corresponds to a first piston of the first plurality of pistons and to a second piston of the second plurality of pistons.

Item 51. A method of mass-producing crankshafts for a piston pump comprising:

segmenting a crankshaft axle precursor formed as an elongated circular rod into a first crankshaft axle and a second crankshaft axle, each of the first and second crankshaft axles having an axle length;

extruding a cam precursor as an elongated non-circular rod;

segmenting the cam precursor into a first plurality of cams and a second plurality of cams, each of the cams in the first and second plurality of cams having a cam width;

machining a central axle opening through each cam of the first and second plurality of cams, the central axle opening having an opening diameter sized to receive an outer diameter of the crankshaft axles;

mounting the first plurality of cams onto the first crankshaft axle by inserting the first crankshaft axle into the central axle opening of the first plurality of cams, and mounting the second plurality of cams onto the second crankshaft axle by inserting the second crankshaft axle into the central axle opening of the second plurality of cams; and rigidly connecting the first plurality of cams to the first crankshaft axle along the axle length of the first crankshaft axle, and rigidly connecting the second plurality of cams to the second crankshaft axle along the axle length of the second crankshaft axle.

Item 52. The method of any preceding item further comprising, before segmenting the crankshaft axle precursor, extruding the crankshaft axle precursor as the elongated circular rod.

Item 53. The method of any preceding item wherein the crankshaft axle precursor comprises a metal alloy.

Item 54. The method of any preceding item wherein extruding the cam precursor comprises extruding the cam precursor from a metal alloy.

Item 55. The method of any preceding item further comprising, after extruding the cam precursor, applying an abrasion-resistance treatment to a surface of the metal alloy of the cam precursor.

Item 56. The method of any preceding item wherein the elongated non-circular rod has a plurality of hollow cores spaced circumferentially about a longitudinally extending cam precursor axis and, after segmenting the cam precursor, each of the cams in the first and second plurality of cams have the plurality of hollow cores.

Item 57. The method of any preceding item wherein segmenting the crankshaft axle precursor comprises cutting the crankshaft axle precursor in a direction transverse to a longitudinally extending crankshaft axle precursor axis at a regular interval along the crankshaft axle precursor axis, the regular interval being the axle length.

Item 58. The method of any preceding item wherein segmenting the cam precursor comprises cutting the cam precursor in a direction transverse to a longitudinally extending cam precursor axis at a regular interval along the cam precursor axis, the regular interval being the cam width.

Item 59. The method of any preceding item wherein:

the central axle opening of each of the cams in the first and second plurality of cams comprises a cam lock recess, the method further comprises securing a first plurality of cam securement pins to the first crankshaft axle, and securing a second plurality of cam securement pins to the second crankshaft axle, the first plurality of securement pins extending radially outwardly from the first crankshaft axle and the second plurality of securement pins extending radially outwardly from the second crankshaft axle;

wherein rigidly connecting the first plurality of cams to the first crankshaft axle includes, for each cam of the first plurality of cams, slidably mating the cam lock recess with a corresponding one of the cam securement pins of the first crankshaft axle, and wherein rigidly connecting the second plurality of cams to the second crankshaft axle includes, for each cam of the second plurality of cams, slidably mating the cam lock recess with a corresponding one of the cam securement pins of the second crankshaft axle.

Item 60. The method of any preceding item, wherein each cam securement pin in the first plurality of cam securement pins has a different angular orientation than at least one other cam securement pin on the first crankshaft axle, and each cam securement pin in the second plurality of cam securement pins has a different angular orientation than at least one other cam securement pin on the second crankshaft axle.

Item 61. A method of mass-producing pistons for a piston pump comprising:

segmenting a piston shaft precursor formed as an elongated rod into a first piston shaft and a second piston shaft, each of the first and second piston shafts having a shaft length extending from a first shaft end to a second shaft end;

applying an abrasion-resistance treatment to a surface of the first piston shaft for at least a portion of the shaft length of the first piston shaft, and applying an abrasion-resistance treatment to a surface of the second piston shaft for at least a portion of the shaft length of the second piston shaft;

extruding a piston crown precursor formed as an elongated profile having a cam engagement side and an opposed shaft engagement side;

segmenting the piston crown precursor into a first piston crown and a second piston crown, each of the first and second piston crowns having the cam engagement side, the shaft engagement side, and a crown width; and connecting the shaft engagement side of the first piston crown to the first shaft end of the first piston shaft, and connecting the shaft engagement side of the second piston crown to the first shaft end of the second piston shaft.

Item 62. The method of any preceding item further comprising extruding the piston shaft precursor from a metal alloy.

Item 63. The method of any preceding item wherein extruding the piston crown precursor comprises extruding the piston crown precursor from a metal alloy.

Item 64. The method of any preceding item further comprising:

forming a threaded portion of the first piston shaft by machining an external thread into the first piston shaft, and forming a threaded portion of the second piston shaft by machining an external thread into the second piston shaft, the threaded portion of each of the first and second piston shafts extending from the first shaft end toward the second shaft end; and drilling an internally threaded bore into the shaft engagement side of the first piston crown, and drilling an internally threaded bore into the shaft engagement side of the second piston crown;

wherein connecting the first piston crown to the first piston shaft comprises threadably connecting the internally threaded bore of the first piston crown to the threaded portion of the first piston shaft, and wherein connecting the second piston crown to the second piston shaft comprises threadably connecting the internally threaded bore of the second piston crown to the threaded portion of the second piston shaft.

Item 65. The method of any preceding item, further comprising machining a bias seat into the shaft engagement side of the first piston crown around the internally threaded bore, and machining a bias seat into the shaft engagement side of the second piston crown around the internally threaded bore.

Item 66. The method of any preceding item wherein segmenting the piston shaft precursor comprises cutting the piston shaft precursor in a direction transverse to a longitudinally extending piston shaft precursor axis at a regular interval along the piston shaft precursor axis, the regular interval being the shaft length.

Item 67. The method of any preceding item wherein segmenting the piston crown precursor comprises cutting the piston crown precursor in a direction transverse to a longitudinally extending piston crown precursor axis at a regular interval along the piston crown precursor axis, the regular interval being the crown width.

Item 68. A method of mass producing piston pumps, the method comprising:

the method of mass producing crankshafts of any preceding item;

the method of mass producing pistons of any preceding item to produce a first plurality of pistons and a second plurality of pistons;

extruding a pump main body precursor formed as an elongated profile having a top wall, a bottom wall, and a rear wall extending between the top and bottom walls;

segmenting the pump main body precursor into a first pump main body and a second pump main body, each of the first and second pump main bodies having the top, bottom, and rear walls, a first side opening, and a second side opening, each of the first and second side openings defined between the top, bottom, and rear walls;

assembling a first piston pump by connecting the first crankshaft, the first plurality of pistons, the first pump main body, and a first pair of sidewalls, and assembling a second piston pump by connecting the second crankshaft, the second plurality of pistons, the second pump main body, and a second pair of sidewalls.

Item 69. The method of any preceding item wherein assembling the first and second piston pumps further comprises:

machining a plurality of piston passages through the rear wall of the first pump main body, and machining a plurality of piston passages through the rear wall of the second pump main body; and slidably mounting each piston of the first plurality of pistons into a corresponding piston passage of the plurality of piston passages of the first pump main body, and slidably mounting each piston of the second plurality of pistons into a corresponding piston passage of the plurality of piston passages of the second pump main body.

Item 70. The method of any preceding item wherein assembling the first and second piston pumps further comprises:

connecting a first sidewall of the first pair of sidewalls to the first pump main body over the first side opening and connecting a second sidewall of the first pair of sidewalls to the first pump main body over the second side opening, and connecting a first sidewall of the second pair of sidewalls to the second pump main body over the first side opening and connecting a second sidewall of the second pair of sidewalls to the second pump main body over the second side opening; and rotatably mounting the first crankshaft axle between the first and second sidewalls of the first pump main body, and rotatably mounting the second crankshaft axle between the first and second sidewalls of the second pump main body.

Item 71. The method of any preceding item wherein assembling the first and second piston pumps further comprises:

engaging the piston crown of each piston of the first plurality of pistons with a corresponding cam of the first plurality of cams of the first crankshaft, and engaging the piston crown of each piston of the second plurality of pistons with a corresponding cam of the second plurality of cams of the second crankshaft.

Item 72. The method of any preceding item further comprising:

machining the first sidewall and the second sidewall of the first pair of sidewalls about a perimeter of each sidewall to produce a central protruding portion bordered by a flange, and machining the first sidewall and the second sidewall of the second pair of sidewalls about a perimeter of each sidewall to produce a central protruding portion bordered by a flange;

inserting the central protruding portion of the first sidewall of the first pair of sidewalls into the first side opening of the first pump main body and inserting the central protruding portion of the second sidewall of the first pair of sidewalls into the second side opening of the first pump main body, the flange of each of the first and second sidewalls of the first pair of sidewalls abutting the top, bottom, and rear walls of the first pump main body, and inserting the central protruding portion of the first sidewall of the second pair of sidewalls into the first side opening of the second pump main body and inserting the central protruding portion of the second sidewall of the second pair of sidewalls into the second side opening of the second pump main body, the flange of each of the first and second sidewalls of the second pair of sidewalls abutting the top, bottom, and rear walls of the second pump main body.

Item 73. The method of any preceding item further comprising connecting the flange of the first and second sidewalls of the first pair of sidewalls to the first pump main body, and connecting the flange of the first and second sidewalls of the second pair of sidewalls to the second pump main body.

Item 74. The method of any preceding item wherein each of the first and second piston pumps has a pumping at least 4 L/min at least at 25 bar when the crankshaft is rotated at 20,000 rpm or less.

Item 75. The method of any preceding item wherein each of the first and second piston pumps has a pump strength coefficient of at least 300 bar·L/min.

The invention claimed is:

1. A piston pump with near-circular cam design for improved longevity and efficiency, the piston pump comprising:

a rotatably mounted crankshaft having a longitudinally extending crankshaft rotation axis, and one or more near-circular cams distributed along the crankshaft axis, each near-circular cam having one or more cam noses and one or more cam heels, the cam noses circumferentially alternating with the cam heels around the crankshaft axis, the cam noses all having a nose radius, the cam heels all having a heel radius, the nose radius being greater than the heel radius, a cam stroke length that is a difference between the nose radius and the heel radius, and a ratio of the nose radius to the heel radius of greater than 1 and less than 1.35; and one or more pistons, each piston in contact with a corresponding near-circular cam of the one or more near-circular cams, each piston slidably mounted relative to the crankshaft between a nose position when in contact with the cam nose of the corresponding near-circular cam, and a heel position when in contact with the cam heel of the corresponding near-circular cam.

2. The piston pump of claim 1 wherein each near-circular cam of one or more near-circular cams is an extrusion-formed cam.

3. The piston pump of claim 1 wherein each near-circular cam of one or more near-circular cams has at least one hollow core.

4. The piston pump of claim 1 wherein each near-circular cam of the one or more near-circular cams is a triangular cam with three cam noses and three cam heels.

5. The piston pump of claim 4 wherein each piston performs a first stroke when the piston moves from the heel position to the nose position and performs a second stroke when the piston moves from the nose position to the heel position, and each piston is driven by the corresponding near-circular cam to perform six strokes for each revolution of the crankshaft.

6. The piston pump of claim 1 wherein each near-circular cam of the one or more near-circular cams is a quadrilateral cam with four cam noses and four cam heels.

7. The piston pump of claim 1 wherein each near-circular cam of the one or more near-circular cams is a pentagonal cam, a hexagonal cam, or an octagonal cam.

8. The piston pump of claim 1 wherein each near-circular cam of the one or more near-circular cams is an ellipsoid cam with two cam noses and two cam heels.

9. The piston pump of claim 1 wherein the one or more near circular cams includes at least two near-circular cams, and each near-circular cam has a different angular orientation than at least one other near-circular cam of the one or more near-circular cams.

10. The piston pump of claim 1 wherein each cam heel of each near-circular cam is flat or convex.

11. The piston of claim 1, wherein each piston has a convexity-size attribute greater than 3 mm.

12. The piston pump of claim 1 wherein the crankshaft comprises a crankshaft axle, and the one or more near-circular cams are removably connected to the crankshaft axle.

13. The piston pump of claim 1 wherein crankshaft comprises a crankshaft axle, each near-circular cam further has a central opening sized to receive the crankshaft axle, and each near-circular cam is slidably removably connected to the crankshaft axle through the central opening.

14. The piston pump of claim 13 wherein:

the crankshaft further comprises one or more cam securement pins distributed along the crankshaft axis and extending radially outwardly from the crankshaft axle, and the central opening of each near-circular cam has a cam lock recess mated with a corresponding one of the cam securement pins.

15. The piston pump of claim 14 wherein each cam securement pin inhibits the mating near-circular cam from rotating relative to the crankshaft axle about the crankshaft axis.

16. The piston pump of claim 14 wherein the one or more cam securement pins comprises at least two cam securement pins, and each cam securement pin has a different angular orientation than at least one other cam securement pin.

17. The piston pump of claim 14 wherein each cam securement pin extends radially outwardly from the crankshaft axle at the same angular orientation.

18. The piston pump of claim 1 wherein the piston pump has a pump strength coefficient of at least 300 bar·L/min.

* * * * *